US006113289A

United States Patent [19]

Saito et al.

[11] Patent Number: 6,113,289

[45] Date of Patent: Sep. 5, 2000

[54] DOT RECORDING DEVICE

[75] Inventors: Kazuo Saito; Eiji Kumai; Masatomo Kanamitsu; Tsuyoshi Tomii, all of Nagano-ken, Japan

[73] Assignee: Seiko Epson Corporation, Tokyo, Japan

[21] Appl. No.: 09/387,027

[22] Filed: Aug. 31, 1999

Related U.S. Application Data

[63] Continuation-in-part of application No. 09/224,392, Dec. 31, 1998.

[30] Foreign Application Priority Data

| | | | |
|---|---|---|---|
| Aug. 31, 1998 | [JP] | Japan | 10-261011 |
| Jul. 27, 1999 | [JP] | Japan | 11-212118 |
| Jul. 30, 1999 | [JP] | Japan | 11-216565 |

[51] Int. Cl.[7] ..... B41J 11/20

[52] U.S. Cl. ..... 400/58; 400/611; 347/41

[58] Field of Search ..... 400/58, 56, 611; 347/3, 9, 33, 41

[56] References Cited

U.S. PATENT DOCUMENTS

| | | | |
|---|---|---|---|
| 5,000,591 | 3/1991 | Burgess | 400/56 |
| 5,610,641 | 3/1997 | Ikado | 347/33 |
| 5,805,176 | 9/1998 | Saito et al. | 400/56 |
| 5,889,537 | 8/1997 | Shimada | 347/9 |
| 5,940,092 | 8/1999 | Kashimura et al. | 400/56 |
| 5,961,224 | 10/1999 | Baitz et al. | 400/56 |
| 6,045,274 | 4/2000 | Nakanishi | 400/54 |

*Primary Examiner*—Eugene Eickholt
*Attorney, Agent, or Firm*—Stroock & Stroock & Lavan LLP

[57] ABSTRACT

A printer is provided wherein printing can be executed continuously after the rear end of printing paper comes off a paper feeding roller without loss in print image quality. Specifically, the position of a point nipped by a paper ejecting roller is placed higher than the position of the top face of a record medium regulating part, and the surface of the paper located upstream of the paper ejecting roller is pressed downward. The position of the top face of the record medium regulating may be varied and backed up. As a result, the rear end of the paper being pressed downward may be caused not to touch the print head. The printer is also provided with a driving controller, that executes an interlace recording method, and the end on the upstream side of the flat top face of the record medium regulating part is located within a range of the array of dot formation elements. The drive controller records a first line of a record object using dot formation elements located at the rear end of the recording head, after the front end of the record medium reaches the end on the upstream side of the top face of the record medium regulating part and is therefore properly positioned. Subsequently, the interlace recording method is executed by repeating sub scanning, by a predetermined sub scanning distance, and main scanning by the recording head.

18 Claims, 16 Drawing Sheets

DOT RECORDING DEVICE

This application is a continuation-in-part application of U.S. application Ser. No. 09/224,392, filed Dec. 31, 1998, now pending.

BACKGROUND OF THE INVENTION

The present invention relates to a dot recording device, such as a serial printer, and more particularly, to a dot recording device including a record medium regulating part and dot recording head in opposed facing relationship, the dot recording device for recording on a record medium that is carried on the record medium regulating part.

With printers, such as serial printers, that have a dot recording head formed to scan a printing medium (e.g., the surface of a paper sheet) along a raster, the recording head is provided with a dot formation element array made up of multiple dot formation elements arrayed in a sub scanning direction on the head surface. Multiple scanning lines of the same color can be simultaneously printed by the dot formation element array with one pass along the main scanning path. As used herein, recording, and derivatives thereof, indicate printing, and derivatives thereof.

In a printer using such a recording head, particularly an ink-jet printer, differences in characteristics of individual ink-jet nozzles (an ink-jet nozzle is equivalent to the dot formation element discussed above) and differences in pitch between ink-jet nozzles are obstacles to realizing printing of high quality images.

U.S. Pat. Nos. 4,198,642 and 5,844,585 disclose a printing method referred to as "interlace recording" in which printing of high quality images is enabled by dispersing variations in the characteristics and pitch of ink-jet nozzles on a printed image.

With interlace recording, a recording head is provided with a nozzle array in which N number of ink-jet nozzles are arrayed in a sub scanning direction at a nozzle pitch k equivalent to k times the dot pitch (k-dot pitch). Nozzle pitch is a function of recording (printing) resolution, which can be measured in dpi. For N number of nozzles, the nozzle pitch k is N or an integer smaller than N. Every time the nozzle array finishes one main scanning path, the print medium is advanced (i.e., sub scanning) a fixed distance equivalent to N times the dot pitch (N-dot pitch).

An illustrative example of the interlace recording method is described below. It is assumed that a nozzle array is provided with 20 (N=20) nozzles arranged at 3-dot pitch (k) to generate an image resolution of 360 dpi. Thus, the one-dot pitch is equivalent to $1/360$ inch, with the pitch between nozzles being $3/360$ inches—the equivalent of 3 (k) times the one-dot pitch. Also, the distance of sub scanning (equal to the field distance the print medium is advanced after the nozzle array completes one main scanning path) is $20/360$ inches which is equivalent to 20 (N) times the one-dot pitch.

As each nozzle is moved by $20/360$ inch when sub scanning is executed, the nozzles are initially moved with each nozzle being moving beyond 7 nozzle positions (nozzle pitches), that is, moving into an advanced position by one-dot pitch ahead of $21/360$ inches. With further sub scanning, each nozzle is moved by 2-dot pitches from the advanced position to a nozzle position ahead of 14 nozzles (14 nozzle pitches). Consequently, when each line is printed by each nozzle in a main scanning path at a certain time, in the subsequent scanning path, an adjacent line is printed by a nozzle moved from 7 nozzle positions away, and in the further subsequent main scanning path, the next adjacent line is printed by a nozzle moved from 14 nozzle positions away.

As described above, in printing according to the interlace recording method, adjacent lines are necessarily printed by different nozzles. As a result, even if there are slight differences in the characteristics of an individual nozzle and pitch, the differences become obscured on a printed image and a printed image of high quality is acquired.

As described above, the interlace recording method may enable printing of high quality images. However, if the interlace recording method is used for printing and started by using all of the nozzles, an area (hereinafter called an "incomplete printed area") is defined at the front end of a record medium in which a line cannot be completely precisely printed using the method. In addition, assuming that a nozzle located at the front end of the recording head in the downstream side in the paper carrying direction is No. 1 and a nozzle located at the rear end of the recording head, on the upstream side is No. N, then printing using all nozzles from Nos. 1 to N cannot be executed when printing is started and only nozzles after a nozzle No. T located between the nozzle No. 1 and the nozzle No. N can be used (driven) when printing is started. However, the nozzle No. T approaches the nozzle No. 1 with every sub scanning. As used herein, "downstream" refers to the direction of paper movement as it passes through the apparatus, and "upstream" is the opposite direction of downstream.

To realize printing of high quality images according to the interlace recording method, the distance between printing paper and the nozzle array, a so-called paper gap, should be held fixed during printing. Therefore, a record medium regulating part is provided in the printing apparatus disposed opposite to the recording head. The paper gap is defined by supporting the paper from the bottom on the flat top face of the record medium regulating part. In a conventional record medium regulating part, the flat top face is provided downstream of the nozzle array (in the sub scanning direction).

The conventional record medium regulating part is composed of a plurality of spaced-apart pieces not linearly arranged in the main scanning direction. Where printing is executed by ink that contains moisture, such as ink-jet printer ink, a slightly wavy phenomenon, known as a "cockling phenomenon", occurs because paper is extended and deformed because of moisture penetration from the ink. The above separated record-medium-regulating-part structure facilitates extinguishing the extension of paper by the above cockling phenomenon between top faces of adjacent pieces.

To hold the above paper gap fixed when printing is started, the front end of paper is made to reach the top face of the record medium regulating part. However, as the flat top face of the record medium regulating part is provided on the downstream side outside a range of the nozzle array, the front end of the paper is located outside the range of the nozzle array with the front end of the paper reaching the top face of the record medium regulating part. Therefore, a range at the front end of the paper cannot be printed upon (the part at the front end of the paper which is downstream of and not opposite to the nozzle array).

Further, as described above, the interlace recording method cannot use all nozzles when printing is started; that is, the nozzles No. 1 to No. T are not aligned with and cannot be initially used.

Recently, a recording device has become desired capable of generating images of high quality, including photograph image quality, which can print with a reduced margin at the upper end of a record medium. As described above, prior art devices have structural limitations which do not permit reducing the margin at the upper end of a record medium.

Heretofore, and referring to the discussion above, Japanese published unexamined patent application No. Hei9-71009, discloses a method for printing a main scanning line in the area including the nozzles No. 1 to No. T. Specifically, a printing method is disclosed wherein an interval of sub scanning (the quantity of a paper feed) is reduced at the start of printing, as compared with the fixed interval of sub scanning in a conventional interlace recording method. A portion of the nozzles on the front end side of the recording head is used to perform the initial printing. According to this printing method, a conventional type interlace recording method is also used. A range which previously could not be printed can be reduced and a margin at the upper end of the printing record can be reduced. However, the method requires two separate printing methods (one at the start of printing and the interlace recording method adopted afterward) which must be switched, resulting in a complicated driving controller.

SUMMARY OF INVENTION

A first object of the present invention is to provide a dot recording device controlled by a simple controller, wherein an image of high quality, equal to a photograph, can be produced by the device having a margin at the upper end thereof sufficiently reduced from that found in the prior art.

As to cockle, the following problems have been experienced in the prior art. As discussed above, in the structure of a conventional record medium regulating part, although the top face is located downstream of the nozzle array and is spaced from paper feeding rollers feeding the paper into the device, the extension and deformation of printing paper due to a cockle is eliminated at the record medium regulating part by the separated structure of the record medium regulating part. However, wavy deformation due to cockle effects portions of the recording medium in a printing area opposite to the nozzle array. As a result, in cases where the wavy deformation is large, there is a problem that the paper gap (space defined between the top face of the record medium and the recording head) partly varies and the high quality of an image in printing cannot be maintained.

Further, there are the following problems in the structure of a conventional type record medium regulating part, as to a case where printing is continued after the rear end of printing paper comes off the paper feeding roller. Specifically, paper is fed through the apparatus during the printing procedure with the rear end of printing paper being nipped by the paper feeding roller located on the upstream side of a recording head and a paper ejecting roller located on the downstream side and printing is effected. Eventually, the rear end of the printing paper comes off the paper feeding roller and becomes free. In a free state, the rear end of the printing paper extends from the side of the paper feeding roller to the top face of the record medium regulating part.

When printing is executed using ink that contains moisture, such as ink-jet printer ink, printing paper is caused to slightly curl because of penetration of the moisture and the deterioration of the rigidity of the paper. The effect with highly rigid paper is not of great concern. However, in the case of printing paper where the rigidity is low, the rear end of the printing paper extending from the side of the paper feeding roller to the top face of the record medium regulating part in a free state cannot be held flat because of the above-identified curl and may tilt downward because of its own weight. If the paper gap varies when, due to the rear end of the printing paper curling and tilting, it may be difficult to maintain the similar high quality of an image in the rear end of the printing paper.

A second object of the present invention is to provide a dot recording device controlled by a simple controller wherein printing an image in which a margin at the upper end can be sufficiently reduced, the wavy deformation due to a cockle of printing paper can be prevented from reaching a printing area opposite to a nozzle array, a paper gap can be held fixed after the rear end of the printing paper comes off the paper feeding roller and becomes free, and printing of high quality images, such as photographs, can be easily achieved.

A third object of the present invention is described below, with reference to a printer formed to typically use printing paper as a record medium. The printer includes a record medium feeding roller pair (also referred to herein as a "paper feeding roller pair") which is arranged upstream of a recording head for controlling the feed rate of the paper. A conventional type printer starts printing from a front end of the printing paper, and the printing paper is carried at a fixed speed by the paper feeding roller through the apparatus with the front end of the printing paper eventuating reaching a medium ejecting roller stack (also referred to herein as a "paper ejecting roller stack") arranged downstream of the print head. For a portion of the printing process, the printing paper is nipped by both the paper ejecting roller stack and the paper feeding roller pair.

The printing paper is carried with tension applied to it by both sets of rollers. In the prior art, the nip defined by the paper ejecting roller stack was formed to be lower than a top face of a record medium regulating part. Therefore, as the rear end of the printing paper came off the paper feeding roller, the rear end of the paper warped upwardly by the top face of the record medium regulating part, and often the printing paper came into contact with the print head. With many conventional printers, printing is not executed once the rear end of the paper comes off the paper feeding roller and the paper is ejected by the paper ejecting roller stack. As is readily apparent, even if the rear end of the printing paper is warped upwardly and is not flat as described above, it is of no consequence in passing through the apparatus without being printed upon.

Where printing is continued after the rear end of paper comes off the paper feeding roller, the paper gap associated with the rear end of the paper is not constant because of the warping, and thus, printing resolution of high quality images may become deteriorated because of contamination where the rear end of the paper comes into contact with the print head. To overcome this problem, a paper feeding device is provided as shown in FIG. 10. Referring to FIG. 10, the paper feeding device is formed so that the position of a nipped point 14 is higher than the position of the top face 15 of a record medium regulating part 9, whereby the nipped point 14 causes the printing paper 8 to be pressed downwardly on the upstream side of the paper ejecting roller 3. With this downward pressure, with most printing paper, as shown by a dashed line in FIG. 10, the rear end 10 of the paper is held flat (that is, spaced from the print head) in a free state released from the paper feeding roller 2 and a paper gap can be held fairly constant throughout the passage of the rear edge.

However, soft flexible paper may deflect downwardly more than paper having normal rigidity due to the downward pressure generated by the paper ejecting roller stack 3. As shown in solid line in FIG. 10, where soft flexible paper is used, the rear end 10 of the paper is lifted by the top face 15 of the record medium regulating part 9 instead of being directed downwardly. Consequently, the paper gap is not maintained constant and, the rear end 10 of the paper may touch the print head 1 and may be contaminated. As shown in FIG. 10, a reference number 4 denotes a driving roller of a paper feeding roller 2, 5 denotes its driven roller, 6 denotes a driving roller of the paper ejecting roller 3, 7 and 17 denote the driven rollers of the paper ejecting roller 3.

The third object of the present invention is to provide a dot recording device which is a printer that continues to print after the rear end of printing paper comes off the paper feeding roller with the rear end of the printing paper being held flat without being influenced by the rigidity and other characteristics of the paper. As such, a paper gap can be held constant after the rear end of the printing paper comes off the paper feeding roller, and printing is continued with execution of high quality images at the rear end of the printing paper.

To achieve the above objects, according to a first aspect of the present invention, a dot recording device is provided which comprises a recording head on the surface of which plural dot formation elements are provided and arranged at substantially fixed pitch in a sub scanning direction; a record medium regulating part is arranged opposite to the surface of the recording head which includes a plurality of spaced-apart members aligned in a main scanning direction and which is provided with a flat top face for regulating an interval of a record medium carried thereon; a main scanning drive unit for executing main scanning by the recording head; a head drive unit for driving the dot formation elements during main scanning and recording on a record medium; a sub scanning drive unit for executing the sub scanning of the record medium; and a driving controller that executes an interlace recording method characterized in that dots of the same color are formed on plural main scanning lines during one main scanning by the recording head by controlling the driving of the main scanning drive unit, the head drive unit and the sub scanning drive unit, plural dots of the same color being formed at a pitch in a sub scanning direction according to recording resolution by vertically scanning the record medium by a predetermined sub scanning distance and recording the dots and adjacent dots in a sub scanning direction by different dot formation elements. With the subject embodiment, the end on the upstream side of the flat top face of the record medium regulating part is located within a range of the array of the dot formation elements, and the driving controller causes a first line of a record object to be recorded at the first end of the record medium using dot formation elements at the rear end of the recording head after the front end of the record medium reaches the upstream end of the top face of the record medium regulating part. Once the first line has been printed, sub scanning by a predetermined sub scanning distance, and main scanning by the recording head are executed according to interlace recording methods.

According to the above configuration, using the interlace recording method, printing is started by recording a first line of the record object using the dot formation elements at the rear end of the dot formation element array (as viewed in the direction of feed of the record medium) after the front end of the recording paper reaches the upstream side of the top face of the record medium regulating part and is therefore properly positioned, a simple driving controller is required and printing of high quality image can be executed. That is, dot formation elements used (driven) for later main scanning include dot formation elements located on the downstream side of the dot formation elements recording the first line of the record object (as used herein the image being printed) but recording of the first line upstream (on the side of the rear end of the paper) from the position of the first recorded line. Because the first line is recorded by the dot formation elements at the rear end of the array during the first main scanning when printing is started, the structure of the controller is simple.

In addition, since the end on the upstream side of the flat top face is located in the range of the array of the dot formation elements, the front end of the recording paper is positioned for printing when the front end of the recording paper reaches the upstream end of the top face. Also in this position, the paper gap is held fixed and constant with the front end of the paper being positioned in the range of the dot formation element array. Therefore, the distance between the position of the first line and the front end of the paper is smaller than that the prior art, and the margin at the upper end can be reduced.

As described above, according to the above configuration, printing is enabled of high quality images, such as photographs in which a margin at the upper end thereof is sufficiently reduced, and, in addition, the printing can be realized with the simple structure of the controller as described above.

Also, according to another aspect of the present invention, the end on the upstream side of the flat top face of the record medium regulating part is provided on the upstream side from the center of a range of the array of dot formation elements.

According to this configuration, as the front end of the recording paper reaches the upstream end of the flat top face which is located on the upstream side from the center of the range of the array of the dot formation elements, distance between the position of the first line to be printed and the front end of the paper becomes smaller and a margin at the upper end of the recording paper can be reduced.

Also, according to another aspect of the present invention, the end on the upstream side of the flat top face of the record medium regulating part is provided in a position approximately equivalent to the dot formation elements at the rear end of the array of dot formation elements. Hereby, approximately any part of a margin at the upper end can be printed.

Also, according to another aspect of the present invention, the end on the downstream side of the flat top face is located upstream from the downstream end of the array of dot formation elements at approximately 30% of the range of the array of dot formation elements. At first when printing is started, only a printed part of the printing paper is wetted by ink and other parts are dry. Therefore, only the printed part has a tendency to be slightly rolled up and curled. When paper is lifted because of the above curl, the paper may come into contact with the surface of the recording head and it may deteriorate the quality of a printed image. As described above, where the flat top face is located in a range of the array of dot formation elements, curled paper may touch the surface of the recording head. However, according to the above configuration, as the end on the downstream side of the flat top face is located upstream from the downstream side of the array of the dot formation elements, the end of the printing paper promptly comes off the end on the downstream side of the top face and can be lowered, even if the paper is slightly rolled up. Therefore, even if deformation due to curl occurs on paper, the effect can be relieved in a direction reverse to the surface of the recording head and the deterioration of the quality of a printed image can be prevented.

Also, according to another aspect of the present invention, a dot recording device is provided which comprises a recording head on the surface of which plural dot formation elements are provided and arranged at substantially fixed pitch in a sub scanning direction; a record medium regulating part is arranged opposite to the surface of the recording head which includes a plurality of spaced-apart members aligned in a main scanning direction and which is provided with a flat top face for regulating an interval of a record medium carried thereon; a main scanning drive unit for executing main scanning by the recording head; a head drive unit for driving the dot formation elements during main scanning and recording on a record medium; a sub scanning drive unit for executing the sub scanning of the record medium; and a driving controller that executes an interlace recording method characterized in that dots of the same color are formed on plural main scanning lines during one main scanning by the recording head by controlling the driving of the main scanning drive unit, the head drive unit and the sub scanning drive unit, plural dots of the same color being formed at a pitch in a sub scanning direction according to recording resolution by vertically scanning the record medium by a predetermined sub scanning distance and recording the dots and adjacent dots in a sub scanning direction by different dot formation elements. With the subject embodiment, the flat top face of the record medium regulating part is provided in a position opposite to and within the range of the array of the dot formation elements, and the length of the top face in a direction in which the record medium is carried is formed so that it is approximately as long as the length of the array of the dot formation elements.

According to the above configuration, a margin at the upper end of a record medium can be sufficiently reduced since distance between the position of a first printed line and the front end of the paper can be made approximately zero depending upon the position of the end on the upstream side of the top face. This is achievable because the length of the top face in the direction in which the record medium is carried of is formed so that it is approximately as long as the length of the array of the dot formation elements. Additionally, as the top face extends across the whole length of the range of the array of dot formation elements with the top face facing and being opposite to the dot formation elements, the paper gap can be held approximately fixed and constant across the whole length of the dot formation element array and printing of high quality image is enabled.

Also, according to another aspect of the present invention, the driving controller is formed so that a first line of a record object to be recorded is recorded using the dot formation elements at the rear end of the recording head after the front end of the record medium reaches the upstream end of the top face of the record medium regulating part and is therefore properly positioned. Subsequently, recording according to the above interlace recording method is executed by repeating sub scanning by a predetermined sub scanning distance and main scanning by the recording head.

According to the above configuration, using the interlace recording method, printing is started by recording a first line of a record object using the dot formation elements at the rear end of the array of dot formation elements after the front end of the recording medium reaches the upstream end of the top face of the record medium regulating part and is therefore properly positioned. A simple controller is required and printing of high quality images is enabled. As a result, printing is enabled of high quality images such as photographs in which a margin at the upper end is sufficiently reduced, and, in addition, printing of high quality images can be realized with a simple structure of the controller.

According to another aspect of the present invention, a dot recording device is provided which comprises a recording head on the surface of which plural dot formation elements are provided and arranged at substantially fixed pitch in a sub scanning direction; a record medium regulating part is arranged opposite to the surface of the recording head which includes a plurality of spaced-apart members aligned in a main scanning direction and which is provided with a flat top face for regulating an interval of a record medium carried thereon; a main scanning drive unit for executing main scanning by the recording head; a head drive unit for driving the dot formation elements during the main scanning and recording on the record medium; a record medium feeding roller arranged near the recording head and on the upstream side of the recording head and characterized in that a point nipped by the record medium feeding roller is located slightly upwardly from the top face of the record medium regulating part so that the record medium is pressed on the top face during feeding of the record medium past the recording head; a paper ejecting roller arranged near the recording head on the downstream side of the recording head for ejecting the record medium downstream; a sub scanning drive unit for executing the sub scanning of the record medium by controlling each rotation of the record medium feeding roller and the paper ejecting roller; and a driving controller that executes an interlace recording method characterized in that dots of the same color are formed on plural main scanning lines during one main scanning by the recording head by controlling the driving of the main scanning drive unit, the head drive unit and the sub scanning drive unit, plural dots of the same color being formed at a pitch in a sub scanning direction according to recording resolution by vertically scanning the record medium by a predetermined sub scanning distance and recording the dots and adjacent dots in a sub scanning direction by different dot formation elements. With the subject embodiment, the end on the upstream side of the flat top face of the record medium regulating part is provided on the side of the record medium feeding roller at the rear end out of the dot formation elements on the recording head.

According to the above configuration, since the end on the upstream side of the flat top face of the record medium regulating part is provided at the rear end out of the array of dot formation elements, the above paper gap can be held fixed and constant before the front end of printing paper enters into the range of the nozzle array. Therefore, if paper feeding is performed so that the front end of the printing paper is located ahead of (on the downstream side in a sub scanning direction) the nozzles which can be driven when printing is started in an interlace recording method, a desired margin at the front end of the printing paper can be deformed. Printing having a desired margin at the front end of the paper and of high quality images can be realized with the simple structure of a controller by starting printing according to the interlace recording method in which sub scanning by a fixed distance and main scanning are alternately repeated in the above state.

Further, according to the above configuration, the distance between the top face of the record medium regulating part and the paper feeding roller, arranged near the recording head on the upstream side thereof, is less than that with conventional designs, thereby causing greater pressure to be applied on the top face to the record medium than in the prior art and the pressure effectively acts in a printing area positioned opposite to the nozzle array, As a result, the effect of wavy deformation due to curling can be prevented from reaching the printing area and therefore, the high quality of an image can be maintained.

Also further, according to the above configuration, since distance between the top face of the record medium regulating part and the paper feeding roller is less than that in a conventional prior art design, the downward gradient of the rear end of the paper in a free state can be reduced, and a fixed paper gap can be securely maintained and printing of high quality images can be realized.

As described above, according to the above configuration, printing with a sufficiently reduced margin at the upper end of the record medium can be realized with a simple structure of the controller, the wavy deformation due to curl of printing paper can be effectively prevented from reaching a printing area opposite to the nozzle array, a paper gap can be also held fixed after the rear end of the printing paper comes off the paper feeding roller and becomes free, and therefore, printing of high quality images can be easily realized.

Also, according to another aspect of the present invention, a dot recording device is provided which comprises a recording head on the surface of which plural dot formation elements are provided and arranged at substantially fixed pitch in a sub scanning direction; a record medium regulating part is arranged opposite to the surface of the recording head, provided with a flat top face for regulating an interval of a record medium carried thereon; a main scanning drive unit for executing main scanning by the recording head; a head drive unit for driving the dot formation elements during main scanning and recording on a record medium; a record medium feeding roller arranged near the recording head on the upstream side of the recording head and characterized in that a point nipped by the record medium feeding roller is located slightly upwardly from the top face of the record medium regulating part so that the record medium is pressed on the top face during feeding of the record medium past the recording head; a paper ejecting roller arranged near the recording head on the downstream side of the recording head for ejecting the record medium downstream; a sub scanning drive unit for executing the sub scanning of the record medium by controlling each rotation of the record medium feeding roller and the paper ejecting roller; and a driving controller that executes an interlace recording method characterized in that dots of the same color are formed on plural main scanning lines during one main scanning by the recording head by controlling the driving of the main scanning drive unit, the head drive unit and the sub scanning drive unit, plural dots of the same color being formed at a pitch in a sub scanning direction according to recording resolution by vertically scanning the record medium by a predetermined sub scanning distance and recording the dots and adjacent dots in a sub scanning direction by different dot formation elements. With the subject embodiment, the end on the upstream side of the flat top face of the record medium regulating part is provided on the side of the record medium feeding roller at the rear end of the dot formation elements on the recording head. Also, the downstream side (in a sub scanning direction) of the record medium regulating part is composed of a plurality of pieces separated from each other in a main scanning direction, and the upstream side of the record medium regulating part (in a sub scanning direction) is not separated in a main scanning direction and the top face is formed so that it is a serial, continuous flat face.

According to the above configuration, since the end on the upstream side of the flat top face of the record medium regulating part is provided outside the range of the nozzle array, ink does not adhere to a part of the printing paper outside the range of the nozzle array. As there is no curling where ink does not adhere, the record medium regulating member for supporting printing paper from the bottom is not required to be separated from each other in a main scanning direction. The upstream side, in a sub scanning direction, of the flat top face is not separated in a main scanning direction and is formed so that the top face is a serial, continuous flat face. The paper gap can be more securely held fixed and constant before printing is started owing to the above serial flat structure.

Also, as the record medium regulating part has structure in which the members are separated from each other in a main scanning direction in an area in which a curl is made on the downstream side in a sub scanning direction, the extension due to a curl of paper is relieved in this area and printing paper can be prevented from being lifted.

Also, according to another aspect of the present invention, the serial structure of the top face on the upstream side of the above record medium regulating part may be divided into some pieces in a main scanning direction. Even if the top face on the upstream side is divided as described above, approximately similar action and effect can be acquired.

Also, according to another aspect of the present invention, the end on the downstream side of the flat top face is located from the downstream end of the array of dot formation elements upstream at approximately 30% of the range of the array of the dot formation elements.

At first when printing is started, only a printed part of the printing paper is wetted by ink and other parts are dry. Therefore, only a printed part has a tendency to be slightly rolled up and curled. When paper is lifted due to the above curl, the paper may come into contact with the surface of the recording head and the quality of a printed image may be deteriorated. Where the flat top face is located in a range of the array of dot formation elements as described above, curled paper may come into contact with the surface of the recording head. However, according to the above configuration, as the end on the downstream side of the flat top face is located upstream from the downstream side of the array of the dot formation elements, the end of the printing paper promptly comes off the end on the downstream side of the top face and can be lowered, even if the above curl exists. Therefore, even if deformation due to curl occurs on paper, the effect can be relieved in a direction reverse to the surface of the recording head and the deterioration of the quality of a printed image can be prevented.

Also, according to another aspect of the present invention, the end on the downstream side of the flat top face of the record medium regulating part is located at the front end out of the dot formation elements or downstream of the elements and beyond the front end thereof.

According to the above configuration, as the top face of the record medium regulating part exists opposite to the dot formation elements and in a wider range than the whole length, the paper gap can be held approximately fixed and constant across a wider range than the whole length of a dot formation element array and certainty in realizing printing of high quality images is enhanced.

Also, according to another aspect of the present invention, a dot recording device is provided which comprises a recording head on the surface of which plural dot formation elements are provided and arranged at substantially fixed pitch in a sub scanning direction; a record medium regulating part is arranged opposite to the surface of the recording head which includes a plurality of members separated from each other in a main scanning direction, and which is provided with a flat top face for regulating an interval of a record medium carried thereon; a main scanning drive unit for executing main scanning by the recording head; a head drive unit for driving the dot formation elements during main scanning and recording on the record medium; a record medium feeding roller arranged near the recording head and on the upstream side of the recording head for feeding the record medium; a paper ejecting roller arranged near the recording head and on the downstream side of the recording head for ejecting the record medium downstream; and a sub scanning drive unit for executing the sub scanning of the record medium by controlling the rotation of the record medium feeding roller and the paper ejecting roller. With the subject embodiment, the dot recording device is formed so that recording by the recording head is continued with the rear end of the record medium being free of the record medium feeding roller and being carried only by the paper ejecting roller. Here, a position of a point nipped by the paper ejecting roller is located higher than the position of the top face of the record medium regulating part (as measured in a direction perpendicular to a route in which the record medium is carried) so that the surface of the record medium located on the upstream side of the paper ejecting roller is pressed downwardly, with the flat top face of the record medium regulating part being located in a range of the array of the dot formation elements.

According to the above configuration, since the top face of the record medium regulating part is located in a range of the array of the dot formation elements, a distance between a point nipped by the paper ejecting roller and the top face of the record medium regulating part is increased, compared with conventional prior art designs. Therefore, inverting and lifting force applied to the rear end of the record medium by the top face of the record medium regulating part is reduced by the paper ejecting roller pressing downwardly with the rear end of the record medium coming off the record medium feeding roller. That is, with the subject invention, continuing recording after the rear end of the record medium comes off the paper feeding roller, the rear end of the record medium can be held flat without being influenced by the rigidity and other characteristics of the record medium after the rear end of the record medium comes off the record medium feeding roller. Additionally, a paper gap can be also held fixed and continuous, and printing is continued with the same quality and printing of high quality images can be executed.

Also, according to another aspect of the present invention, the above dot recording device is provided with a driving controller for executing an interlace recording method characterized in that dots of the same color are formed on plural main scanning lines during one main scanning by the recording head by controlling the driving of the main scanning drive unit, the head drive unit and the sub scanning drive unit, plural dots of the same color being formed at a pitch in a sub scanning direction according to recording resolution by vertically scanning a record medium by a predetermined sub scanning distance and recording the dots and adjacent dots in a sub scanning direction by different dot formation elements. According to the above configuration, printing of high quality images based upon the interlace recording method can be effectively realized.

Also, according to another aspect of the present invention, the position of the top face of the above record medium regulating part is backed up to the vicinity of approximately the center in a sub scanning direction of the recording head. Normally, if the position of the top face of the record medium regulating part is backed up to the vicinity of approximately the center of the recording head, a paper gap with most record media can be held fixed and constant in a state in which the rea r e nd of the record medium comes of f the record medium feeding roller.

Also, according to another aspect of the present invention, the position of the top face of record medium regulating members located at both ends of the record medium regulating part in a main scanning direction is further backed (located further upstream), compared with the position of the top face of other record medium regulating members arranged in the center. In a state in which the rear end of a record medium comes off the record medium feeding roller, the record medium is most easily deformed at its corners. That is, the corners have a tendency to curl and be greatly deformed, compared with the other portions of the paper sheet. According to the above configuration, as the position of the top face of the record medium regulating members located at the corners are further backed, as compared with the position of the top face of other record medium regulating members, the inverting and lifting action generated by the record medium regulating members can be effectively prevented at the corners and the record medium can be held flat. Therefore, a paper gap can be easily held fixed and constant at the corners and printing of high quality images can be executed.

Also, according to another aspect of the present invention, the position of the top face of both record medium regulating members located at both ends is made equal to the position of the top face of the record medium regulating members in the center and an interval between the record medium regulating members located at both ends and the record medium regulating members most backed is formed so that the interval is equivalent to approximately double an interval between other record medium regulating members. According to the above configuration, as an interval between the record medium regulating members at the corners is increased, and there are no record medium regulating members, the inverting and lifting action by the record medium regulating part can be more effectively prevented at the corners and a paper gap of the record medium can be held fixed and constant.

DETAILED DESCRIPTION OF PREFERRED EMBODIMENTS

Figure 1:
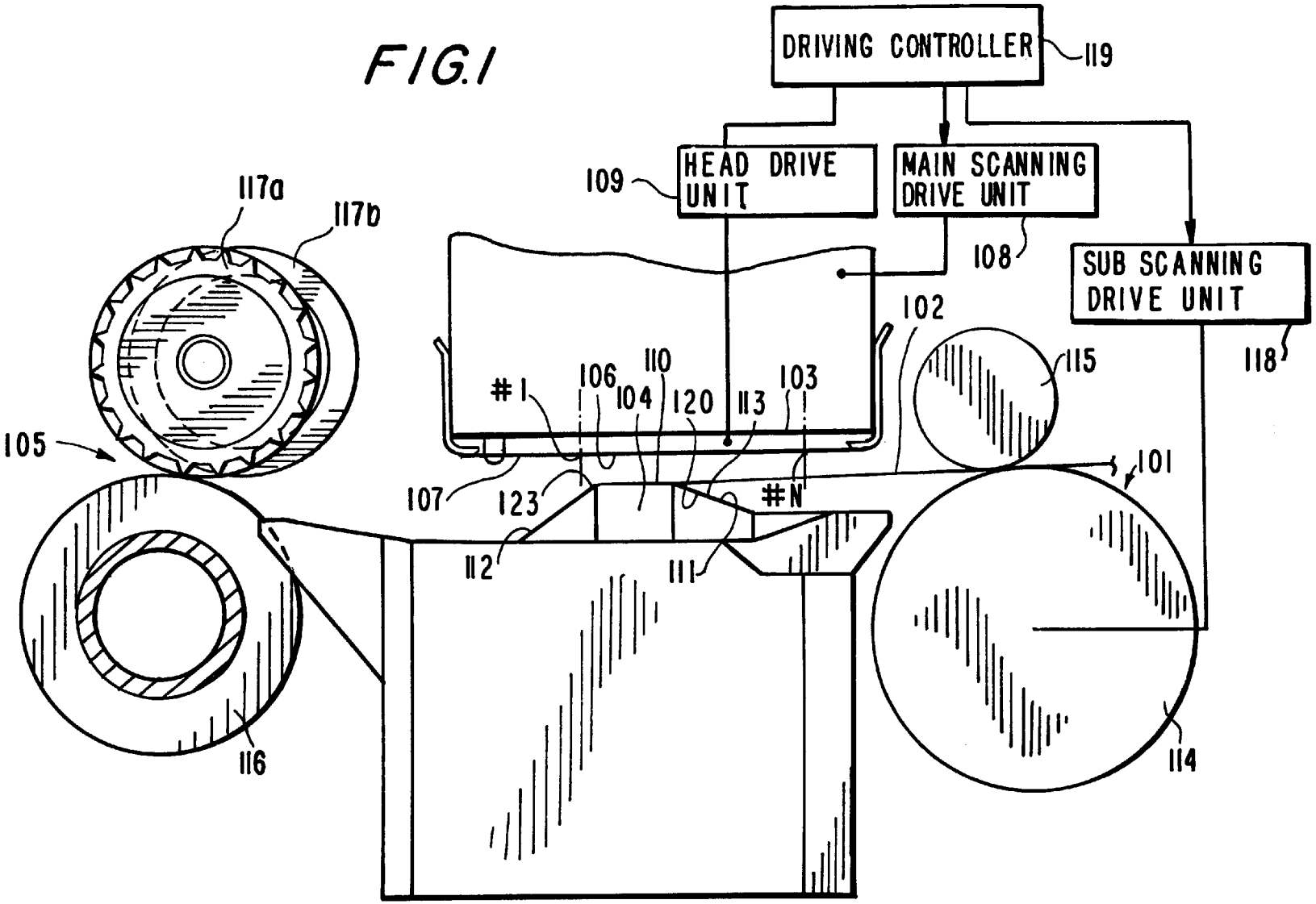
FIG. 1 is a side view showing the main part of a dot recording device in this embodiment.
Figure 2:
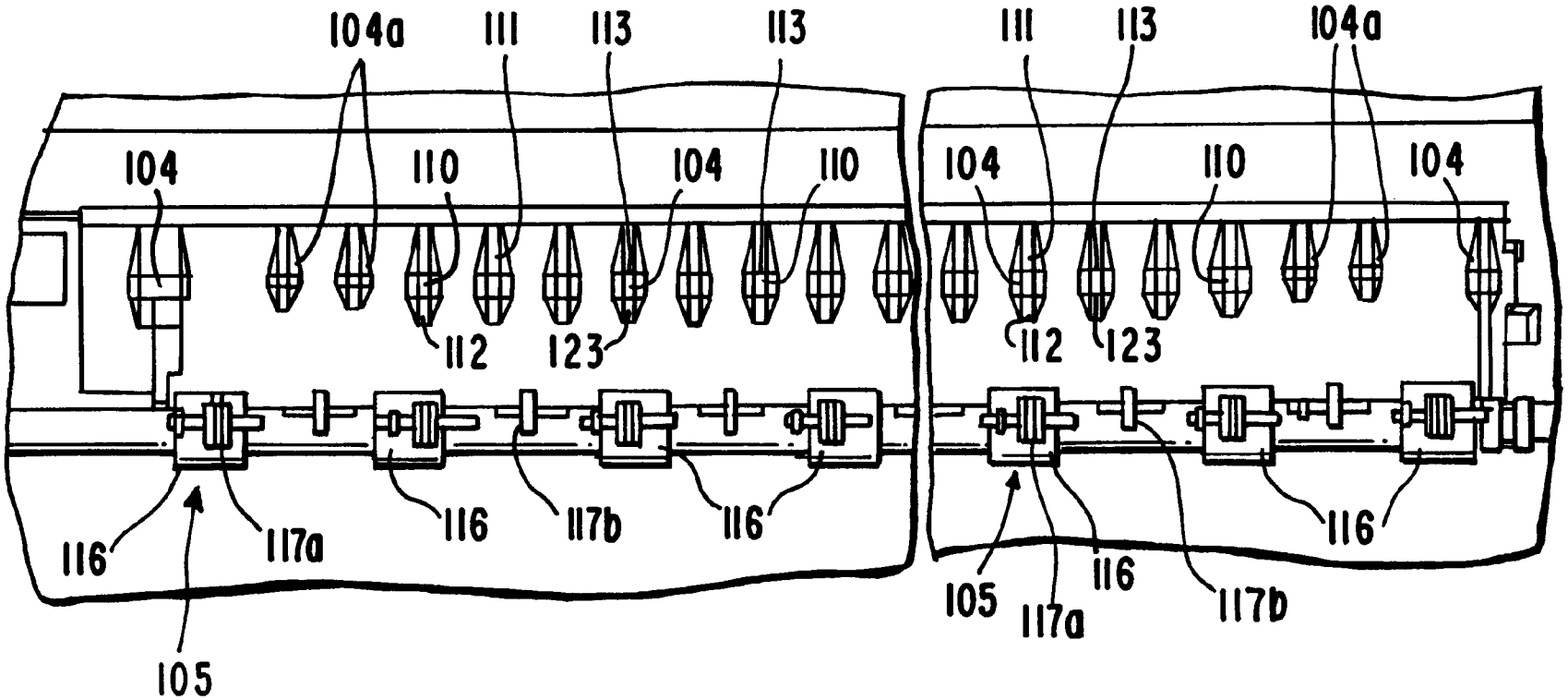
FIG. 2 is a plan view showing the main part of the dot recording device.
Figure 4:
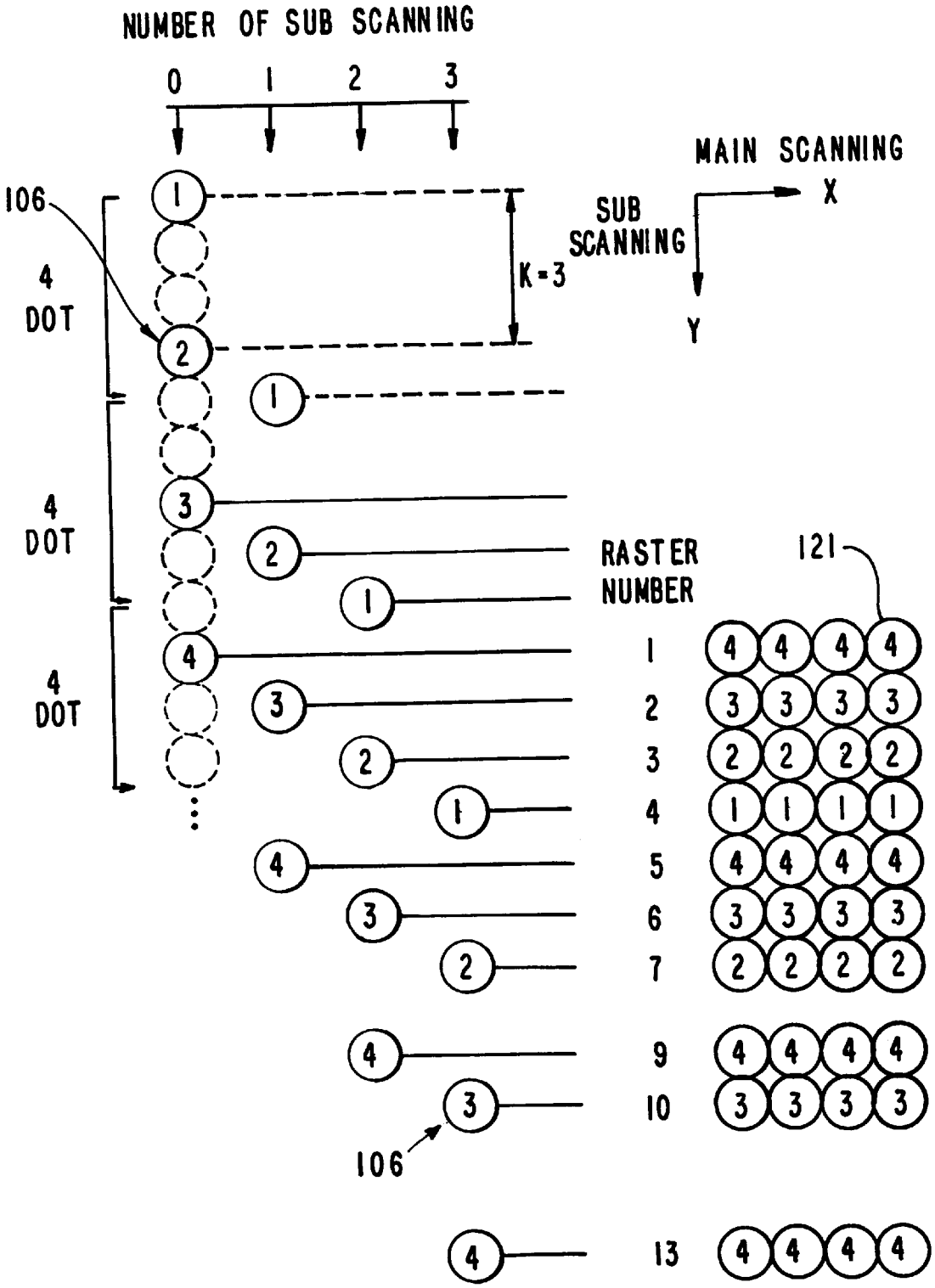
FIG. 4 is an explanatory drawing showing a printing process according to an interlace recording method.

Referring to the drawings, a dot recording device according to the present invention will be described below with an ink-jet printer as an example. FIG. 1 is a side view showing the main part of an ink-jet printer in this embodiment and FIG. 2 is a plan showing -the main part. The ink-jet printer carries a record medium, such as printing paper 102, in a downstream direction (in a sub scanning direction) by a paper medium feeding mechanism, preferably a feeding roller pair 101 as shown in FIG. 4, executes desired printing on the printing paper 102 between a recording head 103 and a record medium regulating part 104 according to print data sent from an external computer and other sources, and ejects the printing paper 102 outside the printer by a paper ejecting mechanism, preferably paper ejecting roller stack 105.

The recording head 103 is provided with plural dot forming elements such as ink jet nozzles, which are arranged at approximately fixed pitch in the sub scanning direction (in a direction in which paper is carried), to define an ink nozzle array 106 on the surface 107. A piezoelectric element (not shown) for helping ink to be jetted is provided to each ink nozzle. A reference number 1 shown in FIG. 1 denotes a nozzle at the front end located on the downstream side of the array in the direction in which paper is carried and a reference number N denotes a nozzle at the rear end located on the upstream side of the array. The recording head 103 can be reciprocated in a main scanning direction (in the direction of the width of the printing paper) by a well-known mechanism not shown and the reciprocation is controlled by a main scanning drive unit 108. During main scanning, each piezoelectric element of the ink nozzle (Nos. 1 to N) is driven by a head drive unit 109 and printing is performed on the printing paper 102.

The record medium regulating part 104 is opposite to the surface 107 of the recording head 103 and as shown in FIG. 2, is preferably formed by a plurality of members (each individually numbered 104) separated from each other and arranged in the main scanning direction. The record medium regulating part 104 has a flat top face 110 (which is collectively defined by the members) and is formed by long ribs in the direction in which paper is carried. Front end 120 of the printing paper 102 sent from an upstream direction is guided to come into contact with a slope on the upstream side 111 of the record medium regulating part 104 and reaches the top face 110. The top face 110 supports the printing paper 102 carried thereon from the bottom and regulates an interval with the ink nozzle array 106, that is, a paper gap. A reference number 112 denotes a slope on the downstream side of the record medium regulating part 104.

The end on the upstream side 113 which forms a boundary with the slope on the upstream side 111 of the flat top face 110 is provided so that it is located in a range of the ink nozzles are arrayed, that is, in a range of the nozzles Nos. 1 to N. In this embodiment, as shown in FIG. 1, the end on the upstream side 113 is preferably located approximately in the center of the range of the ink nozzle array 106.

In this embodiment, the top faces 110 of record medium regulating members 104*a* located in the vicinities of both ends, in the main scanning direction, of the record medium regulating part 104 are formed respectively in states in which the downstream sides of the ends in the sub scanning direction are back of the others as shown in FIG. 2. The reason for this is that the downstream sides of the ends are formed so as to match with the size of printing paper most commonly used with the printer and so as to release during deformation at the corners of the rear end of the paper when the printing paper in that size comes off the paper feeding roller pair 101.

The paper feeding roller pair 101 is preferably composed of a pair of a driving roller 114 and a driven roller 115 and carries the printing paper with the printing paper 102 put between both rollers 114 and 115. The rotation of the driving roller 114 is controlled by a sub scanning drive unit 118 provided with a driving source and the sub scanning drive unit executes the sub scanning of the printing paper 102 by a fixed sub scanning distance every time main scanning is finished during printing. The paper ejecting roller stack 105 is preferably composed of a driving roller 116, driven by a driving source not shown, and two types of driven rollers 117*a* and 117*b* and, formed to eject the printing paper with the printing paper 102 passing between them. Other arrangements of the ejecting roller stack 105 are possible.

Both driving of the main scanning drive unit 108, the head drive unit 109 and the sub scanning drive unit 118 are controlled by a driving controller 119. The driving controller 119 controls each drive unit 108, 109 and 118 based upon print data sent from an external computer (not shown) and a paper position detection signal and other signals sent from a paper position sensor (not shown). The printing paper 102 carried by the paper feeding roller pair 101 is carried in a state in which the position is grasped by the above driving controller 119.

That is, the driving controller 119 instructs the main scanning drive unit 108 to scan the recording head 103 in the main scanning direction and instructs the head drive unit 109 to drive an ink nozzle during one main scanning by the recording head 103 to form dots of the same color on plural main scanning lines. The driving controller instructs the sub scanning drive unit 118 to scan the printing paper 102 in the sub scanning direction by predetermined sub scanning distance, plural dots of the same color being formed in the sub scanning direction at a pitch according to recording resolution by printing the formation of the dots and dots adjacent in the sub scanning direction repeatedly according to an interlace recording method in which recording is performed using different dot formation elements for forming the various dots.

Further, the driving controller 119 records a first line of a record object to be recorded using the nozzle No. N (located at the rear end of the recording head 103) after the front end 120 of the printing paper 102 reaches the end on the upstream side 113 of the top face 110 of the record medium regulating part 104 and is positioned as shown in FIG. 1. Subsequently, recording according to the interlace recording method is performed with repeating sub scanning, by a predetermined sub scanning distance, and main scanning by the recording head 103.

Next, referring to FIGS. 1 to 4, a process in which printing paper is printed by an ink-jet printer according to the above embodiment will be described. The printing paper 102 is carried by the paper feeding roller pair 101 in a state in which the position of the front end 120 of the printing paper 102 is monitored by the driving controller 119. The front end 120 is guided by the slope on the upstream side 111 of the record medium regulating part 104, where it reaches the end on the upstream side 113 of the top face 110. Here, the front end 120 is positioned in a position in which distance between the position of the nozzle No. N and the front end 120 is equal to a predetermined margin at the upper end in print data and further advancement of the printing paper 102 is stopped.

In the embodiment shown in FIG. 1, the front end 120 is shown in a state in which it is positioned at the end on the upstream side 113 of the top face 110. This is equivalent to a case where a margin at the upper end of the printing paper 102 is equal to the distance between the position of the nozzle No. N and the end on the upstream side 113. Therefore, for example, if printing in a margin 3 mm at the upper end of the printing paper 102 is to be enabled, the position of the top face 110 of the record medium regulating part 104 has only to be designed so that the distance between the position of the nozzle No. N and the end on the upstream side 113 is 3 mm.

Figure 3:
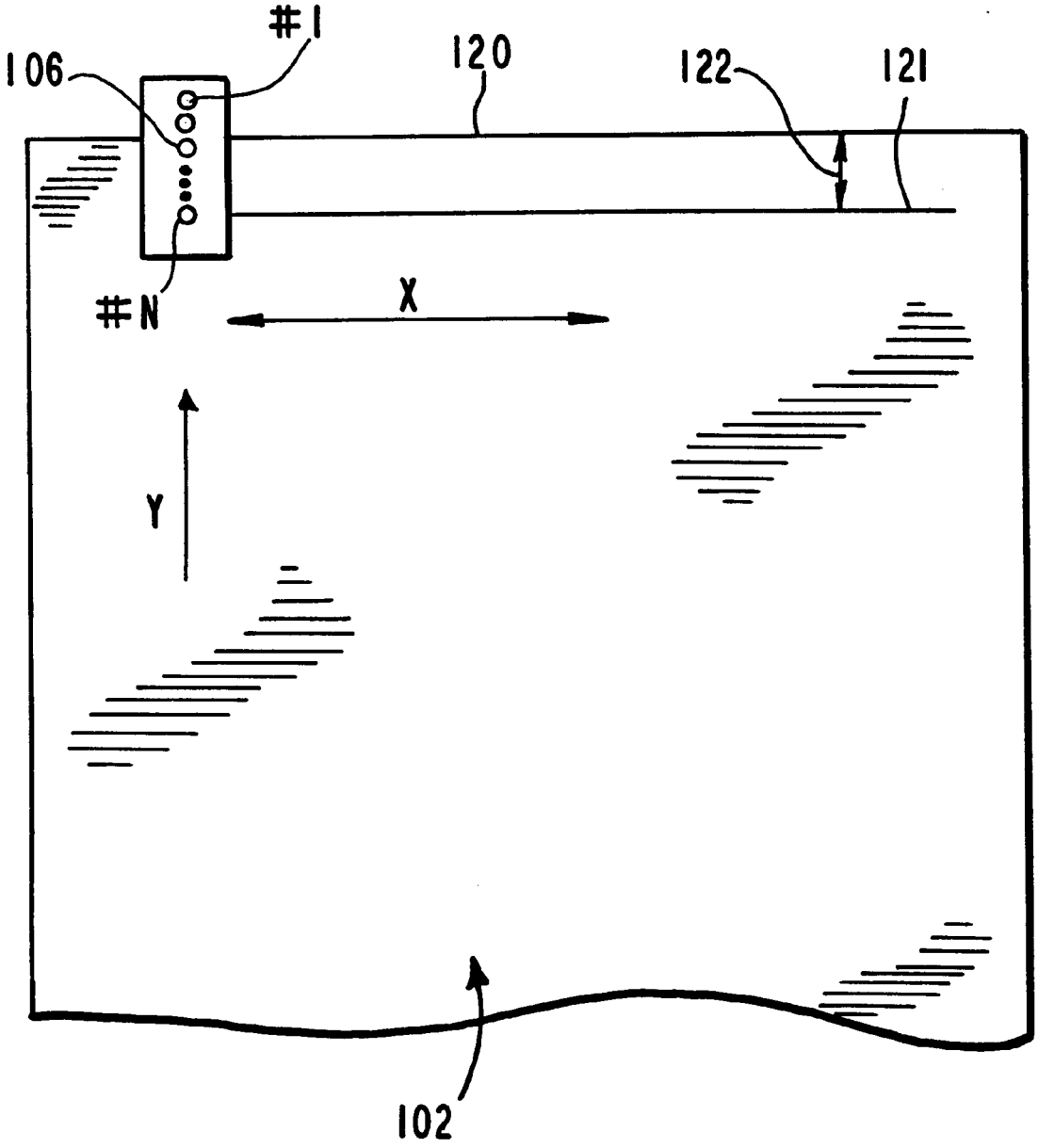
FIG. 3 is a plan view showing an image with a margin at the upper end thereof that is equal to the distance between the position of a nozzle No. N at the rear end of the recording head and the front end of the paper.

FIG. 3 is a plan view showing the relative position of the ink nozzle array 106 and the printing paper 102 when printing is started. As shown in FIG. 3, a reference number 121 denotes a first line printed by the nozzle No. N and 122 denotes a margin at the upper end. Also, a reference number X denotes the main scanning direction and Y denotes the sub scanning direction (a direction in which paper is fed). The direction Y represents the downstream direction; the upstream direction is in the opposite direction.

Next, referring to FIG. 4, a printing process according to an interlace recording method will be described concretely. In the interlace recording method, for illustrative purposes, the number (N) of nozzles included in the ink nozzle array 106 is set to 4, pitch (k) between adjacent nozzles is set to 3 dots and sub scanning distance is set to 4 dots. It is to be understood that these numbers are being presented to illustrate the practice of the invention and, in no way are limiting . Other values are usable. A digit in a circle in FIG. 4 shows a nozzle number. The nozzles Nos. 1–4 are numbered in descending order going downstream.

At first, only the nozzle No. 4 at the rear end of the recording head is driven during the initial main scanning and the first line 121 is printed by nozzle No. 4. That is, in the first main scanning, the nozzles Nos. 1 to 3 are not driven. Hereby, a first line is printed on a line having a raster number 1 shown in a right part of FIG. 4 and designated with the nozzle No. 4.

First sub scanning is then executed and the recording head 103 again scans. At this time, only the nozzles Nos. 3 and 4 are driven. Hereby, lines having raster numbers of 2 and 5 are printed. Second sub scanning is executed and the nozzles Nos. 2 to 4 are driven. Hereby, lines having raster numbers of 3, 6 and 9 are printed. Third sub scanning is executed and this time, printing is executed using all nozzles (Nos. 1 to 4). Hereby, lines having raster numbers of 4, 7. 10 and 13 are printed. Afterward, sub scanning is executed ahead by 4 dots and printing using all nozzles are repeated.

According to the above embodiment, printing is started by printing the first line 121 of a printed object using only the nozzle No. 4 (N) after the front end 120 of the printing paper 102 has reached the end on the upstream side 113 of the top face 110 of the record medium regulating part 104 and is positioned. As a result, the structure of the controller is not complicated, can be simplified, and printing of high quality images is enabled. That is, as the first line 121 is recorded by the nozzle No. 4 in the first main scanning for starting the printing, nozzles driven in subsequent main scannings are located downstream from the paper and downstream from the position of the first line 121, ready for subsequent sub scannings and therefore, the structure of the controller is simplified.

In addition, as the end on the upstream side 113 of the flat top face 110 is located within a range of the ink nozzle array 106, the front end 120 of the paper, when the front end 120 of the printing paper 102 is positioned at the end on the upstream side 113 of the top face 110, is located in a range of the nozzle array 106 with a fixed paper gap. A distance between the position of the first line 121 and the front end 120 of the paper is smaller than that in conventional designs, a margin at the front end 120 of the paper sheet 102 can be reduced from the prior art.

Figure 5:
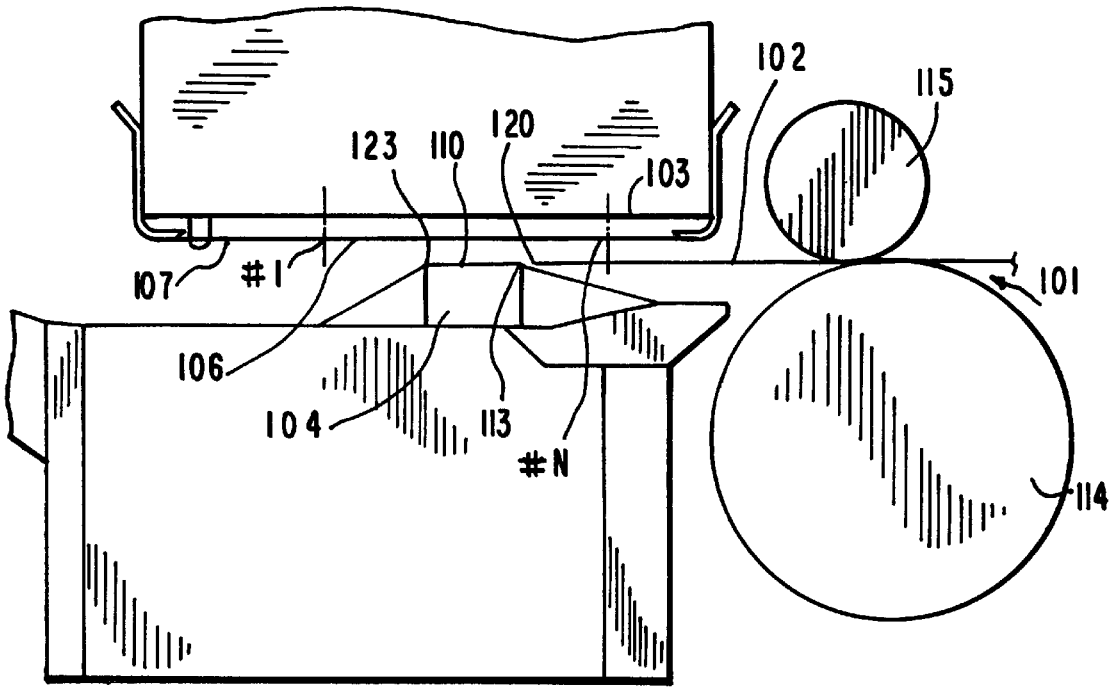
FIG. 5 is a side view of the main part showing another embodiment of the dot recording device according to the present invention.

FIG. 5 is a side view of the main part showing another embodiment of the ink-jet printer according to the present invention. In this embodiment, the end on the upstream side 113 of the flat top face 110 is provided on the upstream side from the center of a range of the ink nozzle array 106. As the other configuration is similar to that in the embodiment shown in FIG. 1, the same reference numbers are allocated to the same parts and the descriptions thereof are omitted.

According to this embodiment, as the end on the upstream side 113 of a flat top face 110 which the front end 120 of printing paper 102 reaches is located on the upstream side from the center of a range of the nozzle array 106, distance between the position of a first line 121 and the front end 120 of the paper is further made smaller and a margin at the upper end 122 can be further reduced.

Figure 6:
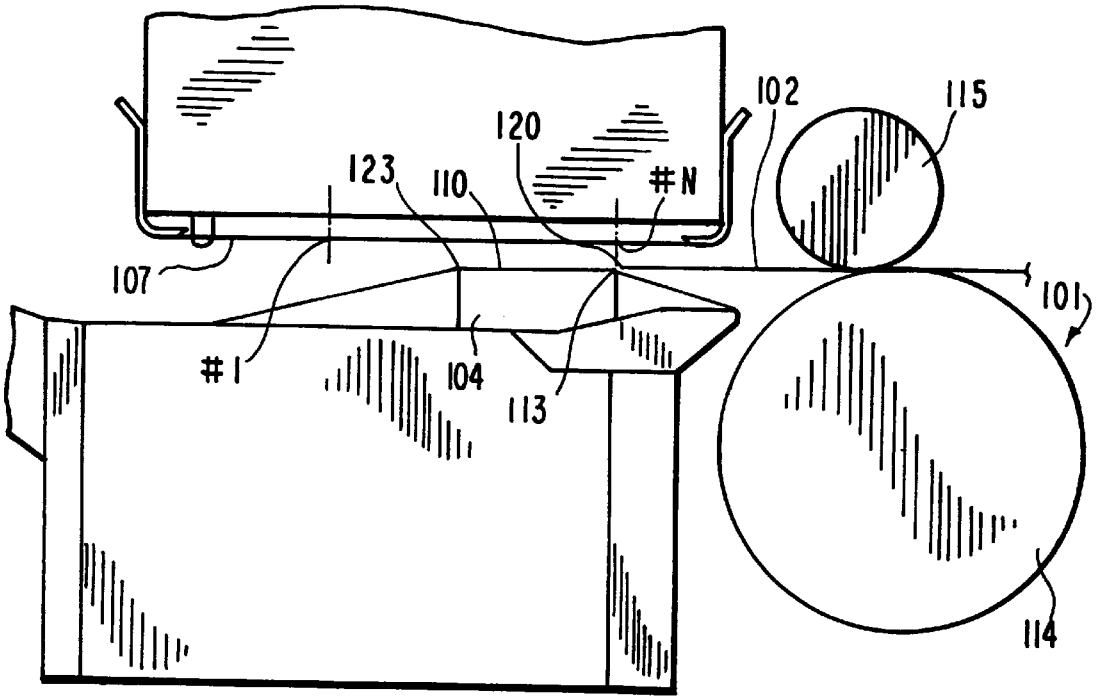
FIG. 6 is a side view of the main part showing a further embodiment of the dot recording device according to the present invention.

FIG. 6 is a side view of the main part showing further another embodiment of the ink-jet printer according to the present invention. In this embodiment, the end on the upstream side 113 of a flat top face 110 is provided in a position approximately equivalent to nozzle No. N located at the rear end of the nozzle array 106. Hereby, printing an insubstantial margin at the upper end 122 is possible.

If the end on the downstream side 123 of the flat top face 110 is provided on the upstream side from a range equivalent to approximately 30% on the downstream side in a range of the nozzle array 106, the following effect is acquired.

At first when printing is started, only a printed part is wetted by ink and the other part is dry. Therefore, only a printed part has a tendency to be slightly rolled up. However, if the end on the downstream side 123 of the flat top face 110 is located on the upstream side from a range equivalent to approximately 30% on the downstream side as described above, the front end of the paper promptly comes off the end on the downstream side 123 of the top face 110 and can be lowered even if there is a curl. Therefore, even if deformation due to a curl occurs on the paper 102, the effect can be relieved in a direction reverse to the surface 107 of a recording head and the deterioration of the quality of a printed image can be prevented.

Figure 7:
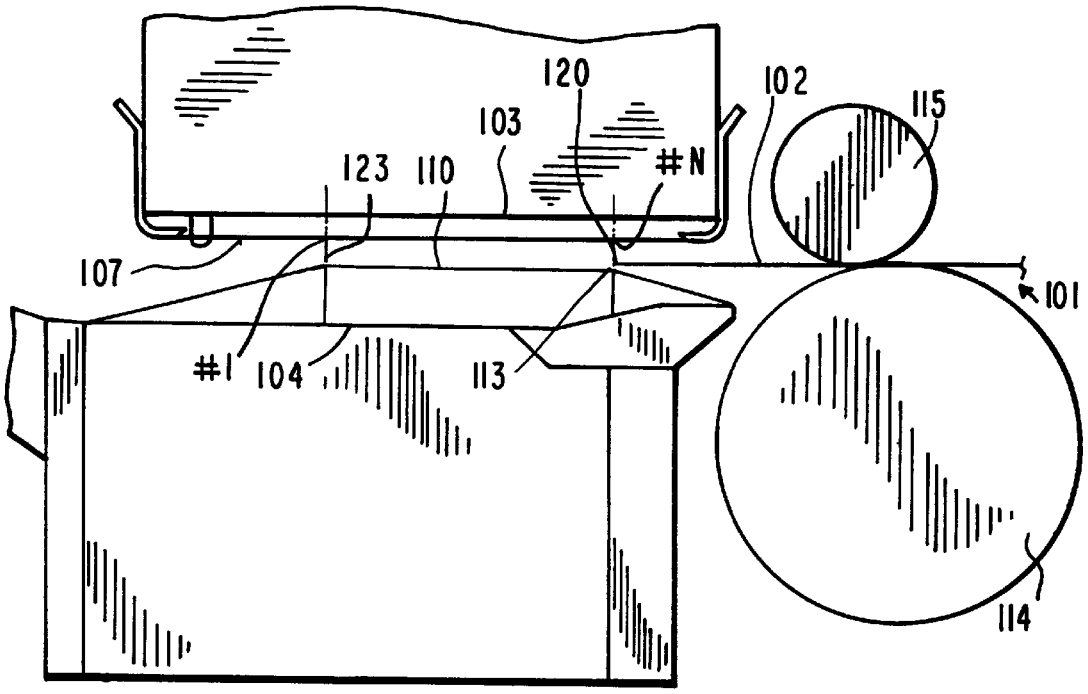
FIG. 7 is a side view of the main part showing yet a further embodiment of the dot recording device according to the present invention.

FIG. 7 is a side view of the main part showing further another embodiment of the ink-jet printer according to the present invention. In this embodiment, the flat top face 110 of a record medium regulating part 104 is provided in a position opposite to a range of a nozzle array 106 and the length in a direction in which a record medium is carried of the top face 110 is formed so that it is approximately as long as the length of the nozzle array 106. As the other configuration is similar to that shown in FIG. 1, the same reference numbers are allocated to the same parts and the descriptions thereof are omitted.

According to this embodiment, first, the distance between the position of a first line 121 and the front end 120 of the paper can be made approximately zero depending upon the position of the end on the upstream side 113 of the top face 110, and, therefore, the margin at the upper end 122 can be sufficiently reduced. Second, as the top face 110 exists across the whole length of the nozzle array 106 opposite to the nozzle array, the paper gap can be held approximately fixed across the whole length of the nozzle array 106 and printing of high quality image is enabled. As a result, printing of high quality image, such as photographs, in which a margin at the upper end is sufficiently reduced is enabled and such printing can be realized with the simple structure of a controller.

As described above, according to the present invention, printing of high quality images as in a photograph in which a margin at the upper end is sufficiently reduced is enabled and such printing can be realized with the simple structure of the controller.

Figure 8:
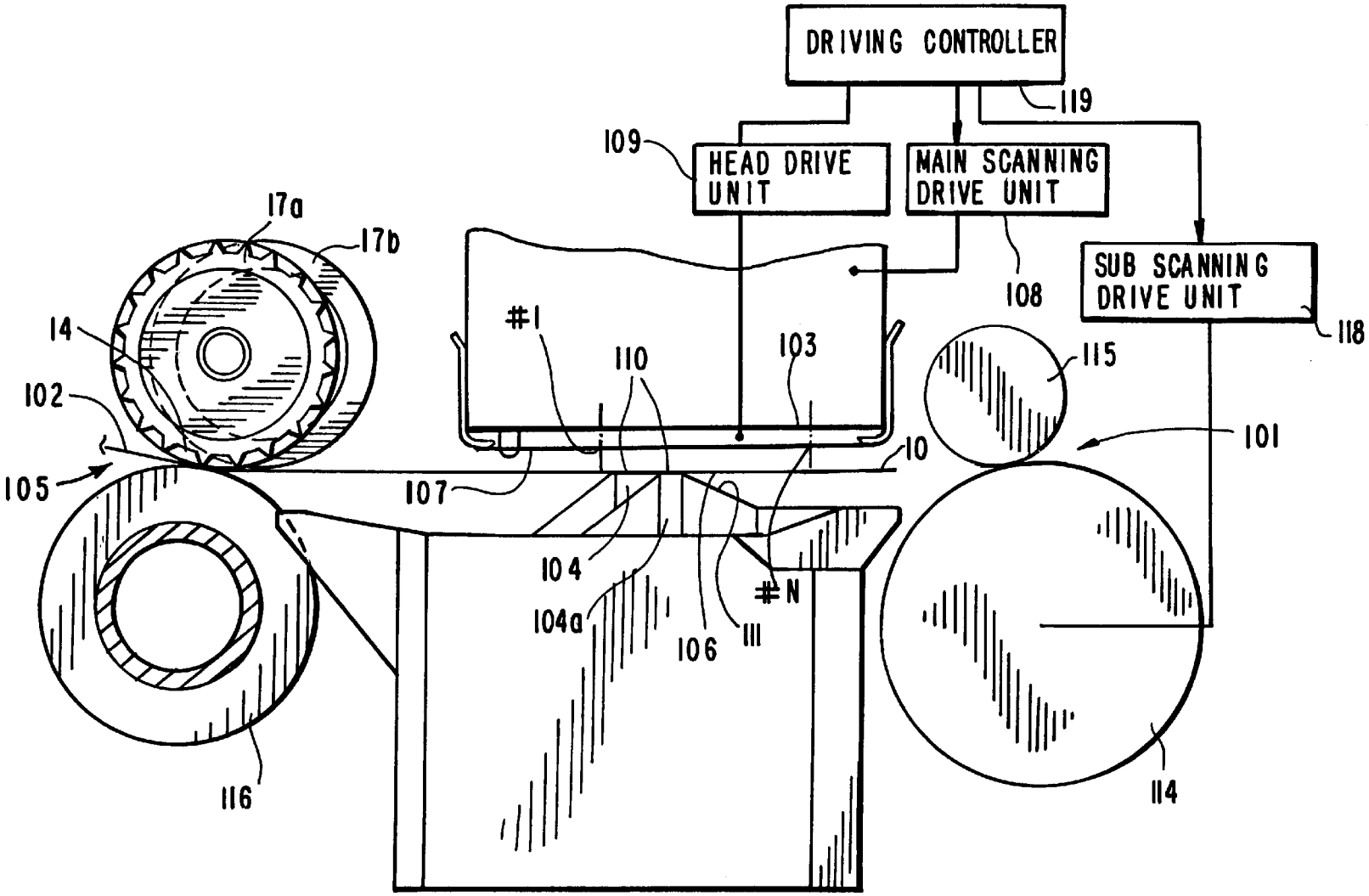
FIG. 8 is a sectional view of the main part showing a state immediately after the rear end of paper comes off a paper feeding roller of a paper feeding device equivalent to an embodiment of the present invention of a printer.
Figure 9:
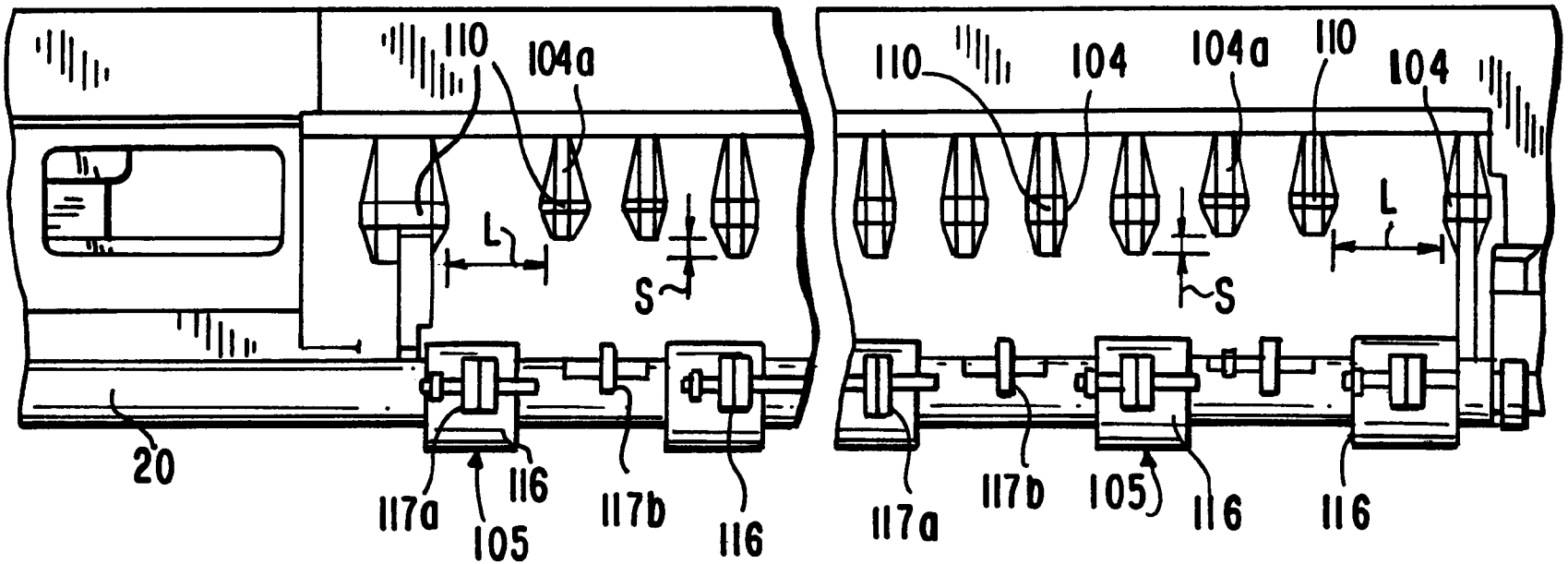
FIG. 9 is a plan view showing a record medium regulating part of the paper feeding device.
Figure 10:
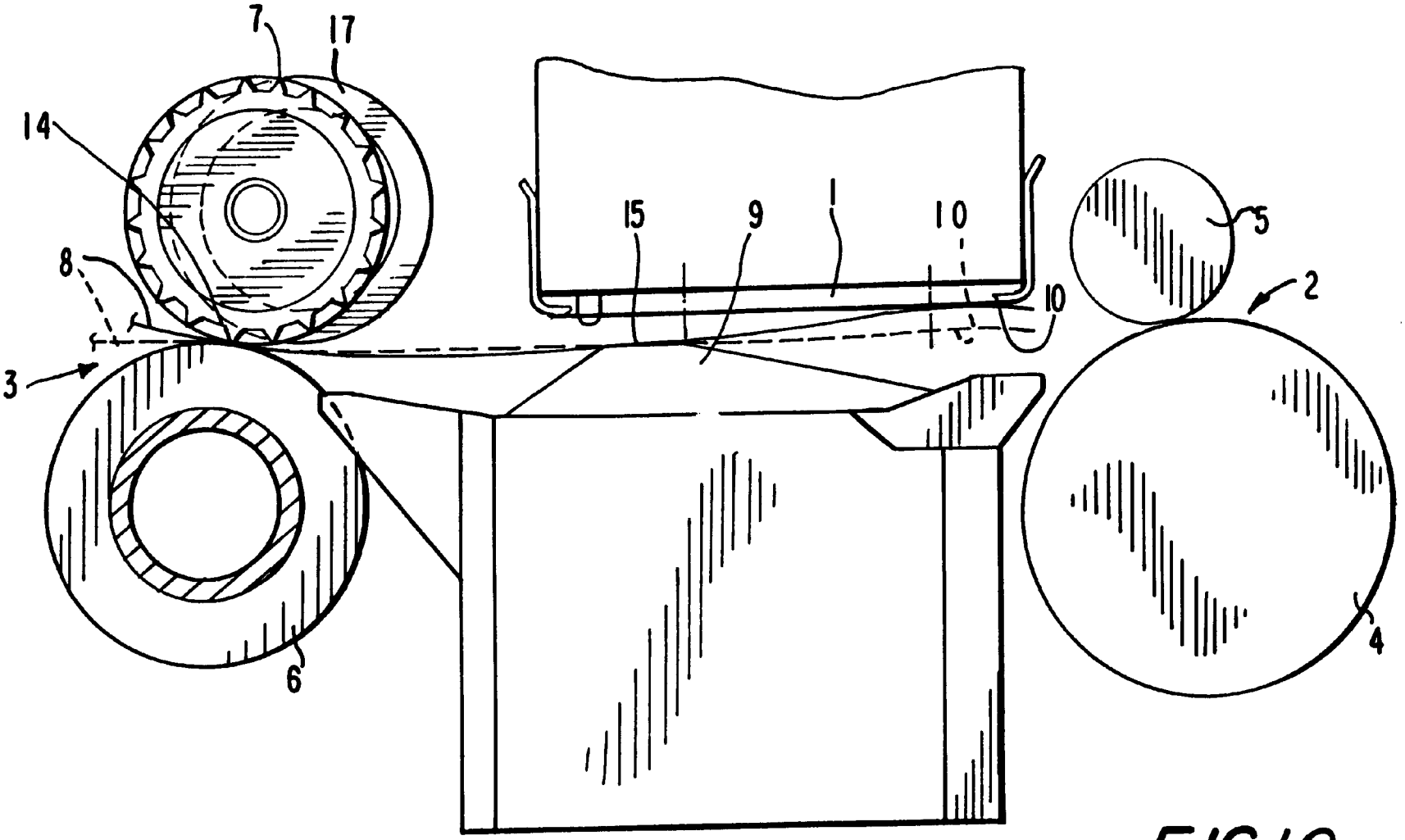
FIG. 10 is a sectional view of the main part showing a state immediately after the rear end of paper comes off the paper feeding roller of the paper feeding device in which the position of the top face of the record medium regulating part is not backed of the printer.

Next, referring to the drawings, another aspect of the dot recording device according to the present invention will be described, giving an ink-jet printer as an example. FIG. 8 is a sectional view of the main part showing a state immediately after the rear end of paper coming off a paper feeding roller pair in an ink-jet printer equivalent to an embodiment of the present invention and FIG. 9 is a plan showing a record medium regulating part composing a paper feeding device of the printer. As parts other than a part described below are composed as in the above embodiment shown in FIG. 1, the same reference numbers are allocated to the same parts and the descriptions thereof are omitted.

In this embodiment, the paper feeding device of the inkjet printer is provided with a paper feeding roller pair 101 arranged in the vicinity on the upstream side of a print head 103 and a paper ejecting roller stack 105 arranged in the vicinity on the downstream side of the print head 103 as shown in FIG. 8. The print head 103 is formed so that it can be reciprocated in the main scanning direction by a main scanning drive unit 108. Also, the sub scanning of printing paper 102, that is, paper feeding is executed by controlling rotation of the paper feeding 40 roller pair 101 and the paper ejecting roller stack 105 by a sub scanning drive unit 118.

The printer is configured so that printing by the print head 103 is also continued in a state in which the rear end 10 of the printing paper 102 comes off the paper feeding roller pair 101 and the printing paper is carried by only the paper ejecting roller stack 105. In this embodiment, the printer is composed so that printing is enabled up to approximately 3 mm of the rear end 10 of the paper 102, that is, up to a bottom margin 3 mm.

The paper feeding roller pair 101 is composed of a pair of a driving roller 114 to which power is transmitted from a driving motor not shown controlled by the sub scanning drive unit 118 via a gear not shown and a driven roller 115. The paper ejecting roller stack 105 is composed of a pair of a driving roller 116 to which power is transmitted from the above driving motor also used in the case of the paper feeding roller 101 via a gear not shown and driven rollers 117*a* and 117*b*. Plural driving rollers 116 are arranged with them separated from each other in the direction of a shaft on the common shaft 20 as shown in FIG. 9 and each driving roller 116 is formed so that the width is approximately equal.

In this embodiment, the paper ejecting roller stack is formed so that the position of a point 14 nipped by the paper ejecting roller stack 105 is higher in a direction measured perpendicular to a route in which paper is carried than the position of the top face 110 of the record medium regulating part 104 (higher by 0.2 mm in this example). As a result of this arrangement, the surface of the paper 102 located on the upstream side of the paper ejecting roller 105 is pressed downward. That is, in this example, the paper ejecting roller stack is formed so that the position of the point 14 nipped by the paper ejecting roller 105 is higher by approximately 0.2 mm than the top face 110 of the record medium regulating part 104, thereby causing the surface of the paper 102 located on the upstream side of the paper ejecting roller stack 105 to be pressed on the top face 110.

The record medium regulating members 104 are arranged opposite to the print head 103 with them separated from each other in the main scanning direction as shown in FIG. 9. The top face 110 of the record medium regulating part 104 is provided so that it is located in a range of a nozzle array 106 as shown in FIG. 8. Concretely, the top face 110 is backed up to the vicinity of approximately the center of the print head 103. Needless to say, the position of the top face 110 of the record medium regulating part 104 may be also further backed or may be also moved slightly ahead in a range which does not obstruct. That is, distance between the point 14 nipped by the paper ejecting roller stack 105 and the top face 110 of the record medium regulating part 104 is increased, as compared with that in conventional structure and as a result, inverting and lifting force by the top face 110 of the record medium regulating part 104 applied to the rear end 10 of the printing paper is reduced by the paper ejecting roller stack in a state in which the rear end 10 of the printing paper 102 comes off the paper feeding roller pair 101.

In other words, in a printer of a type that recording is continued after the rear end 10 of the printing paper 102 comes off the paper feeding roller pair 101, the rear end 10 of the printing paper 102 is held flat without being influenced by the rigidity and other characteristics of the printing paper 102 after the rear end 10 of the printing paper 102 comes off the paper feeding roller pair 101. Therefore, a paper gap can be held fixed in a state in which the rear end 10 of the printing paper 102 comes off the paper feeding roller pair 101, and printing is continued as it is and printing of high quality images can be executed. Normally, as shown in FIG. 8, if the top face 110 of the record medium regulating part 104 is backed up to the vicinity of approximately the center of the print head 103 in the sub scanning direction, the rear end 10 of most paper can be held flat.

Also, in this embodiment, the position of the top face 110 of a record medium regulating member 104*a* arranged at the ends of both sides in the main scanning direction of the above plural record medium regulating members 104 is further backed by distance S, compared with the top face 110 of the other record medium regulating members 104 arranged in the center as shown in FIG. 8. The above design complies with the size of printing paper which is estimated to be most used for the printer and is adopted to relieve deformation at the corners at the rear end of the paper when the printing paper of the predetermined size comes off the paper feeding roller 101 and becomes free.

However, in this embodiment, as shown in FIG. 9, all record medium regulating members 104 at the ends on both sides are not backed by distance S and the position of the top face 110 of each record medium regulating member 104 located most outside is arranged as are the record medium regulating members 104 in the center. An interval L between the record medium regulating member 104 located most outside and the record medium regulating member 104*a* most backed is formed so that the interval is approximately twice as wide as an interval between the other record medium regulating members 104. This is substantially equivalent to the removal of one of the record medium regulating members 104 at both ends and an interval in that part is increased. Hereby, by removing the record medium regulating member 104 in parts where inverting and lifting action is most easily applied, the inverting and lifting action by the record medium regulating member 10 can be more effectively reduced at the corners and the rear end 10 after the printing paper 102 comes off the paper feeding roller pair 101 can be held flat.

As the printer is an ink-jet printer of a type that printing is executed according to an interlace recording method, the effect acquired by applying the present invention that a print of high quality images as in a photograph is acquired by locating the record medium regulating part in a range of the nozzle array 106 is remarkable.

As described above, according to the present invention, as the position of the top face 110 of the record medium regulating member is backed up to a position i n which the above inverting and lifting action by the top face 110 of the record medium regulating part 104 hardly comes into question, the side of the rear end 10 of the paper can be also held flat without being influenced by difference in the rigidity an d other characteristics of the paper 102 after the rear end 10 of the printing paper 102 comes off the paper feeding roller pair 101. Therefore, even if printing is continued as it is, printing of high quality images can be executed.

To avoid having the paper ejection speed of the paper ejecting roller stack 105 be slower than the paper feeding speed of the paper feeding roller pair 101, the paper ejection speed is set so that it is faster than the paper feeding speed of the paper feeding roller pair 101 by speed increasing ratios and in a state in which both the paper feeding roller pair 101 and the paper ejecting roller stack 105 respectively nip the printing paper 102. Speed is controlled so that the paper 102 is fed at the paper feeding speed of the paper feeding roller pair 101. Therefore, in a state in which the printing paper 102 is carried with the paper respectively nipped by the paper feeding roller pair 101 and the paper ejecting roller stack 105, back tension is applied to the paper ejecting roller stack 105.

Figure 11:
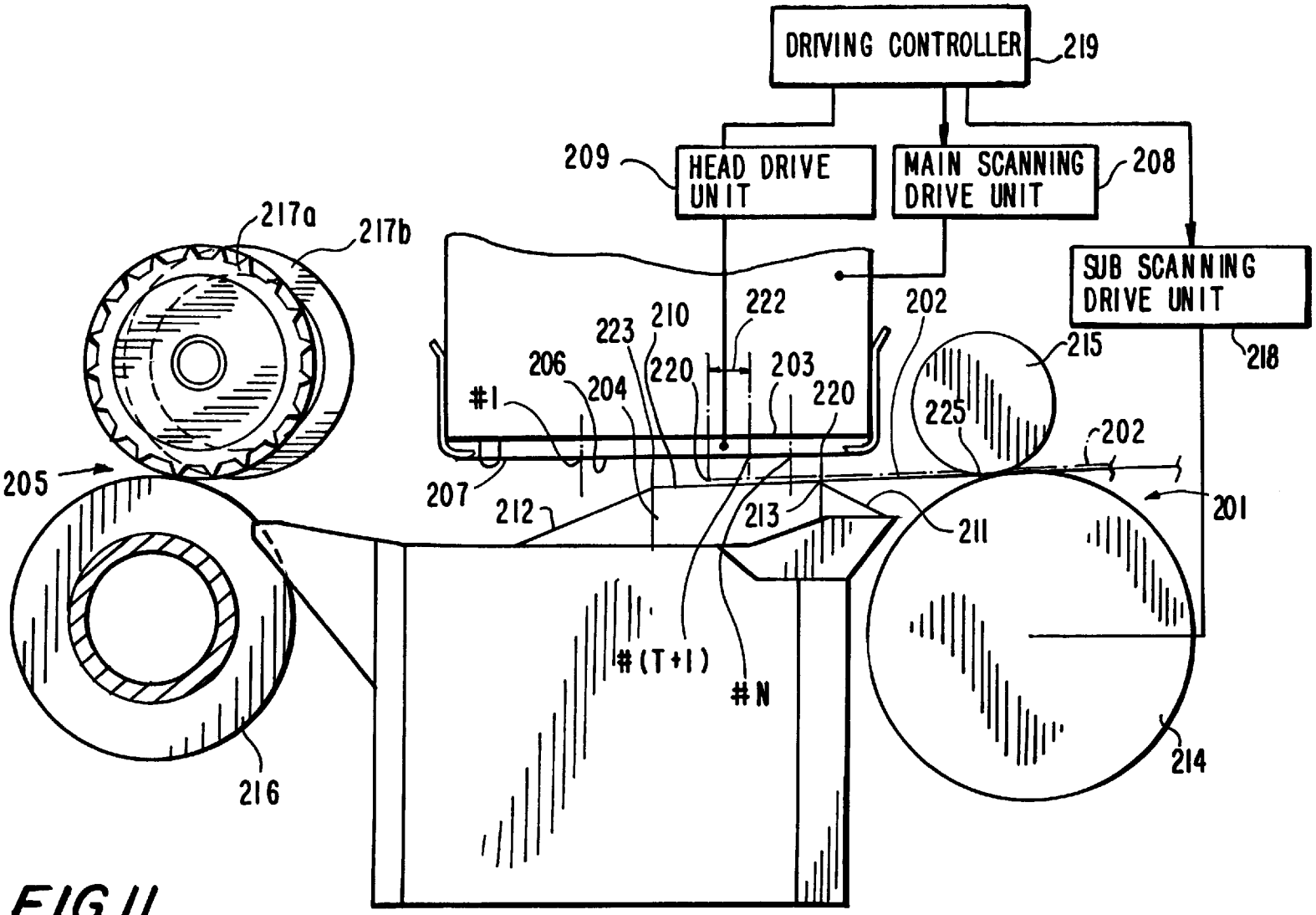
FIG. 11 is a side view showing the main part of the dot recording device equivalent to the embodiment.
Figure 12:
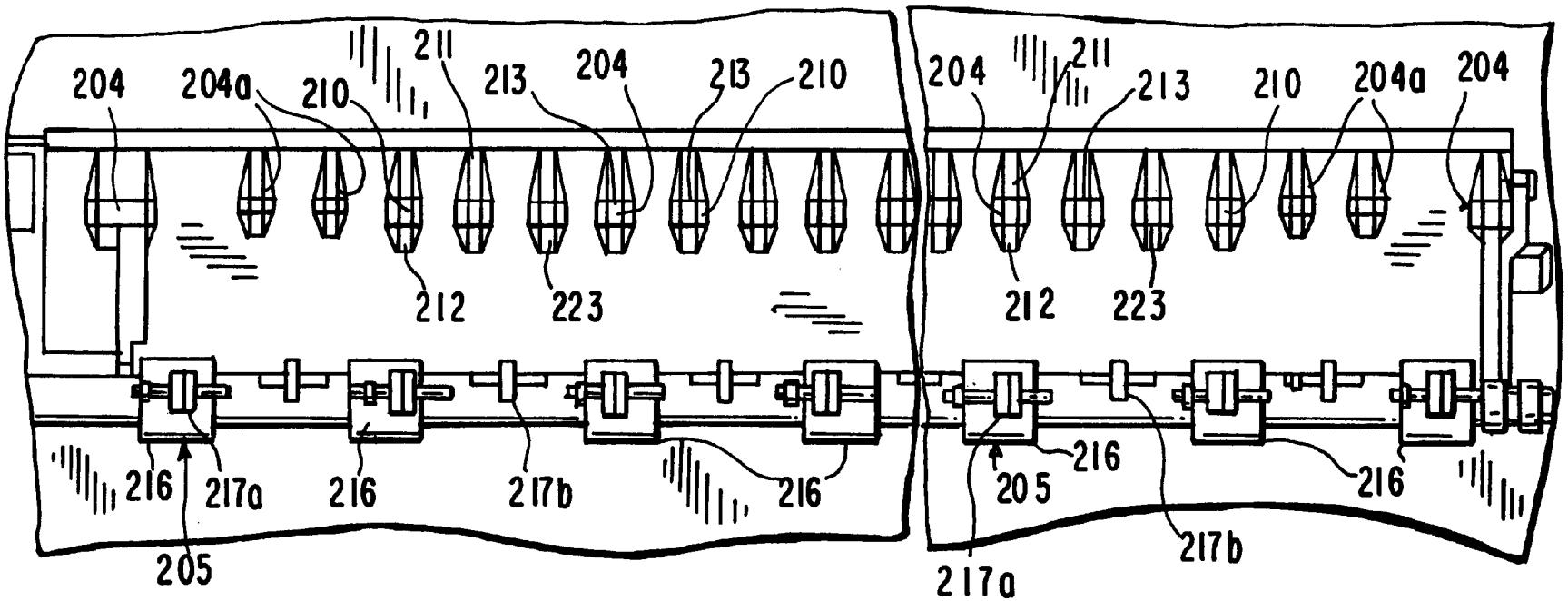
FIG. 12 is a plan showing the main part of the dot recording device.

Next, referring to the drawings, further another aspect of the dot recording device according to the present invention will be described, giving an ink-jet printer as an example. FIG. 11 is a side view showing the main part of an ink-jet printer equivalent to this embodiment and FIG. 12 is a plan view showing the main part. As shown in FIG. 11, the ink-jet printer is composed approximately as in the embodiment shown in FIG. 1. In this embodiment, reference numbers of 200s are allocated to members similar to those of the embodiment shown in FIG. 1, in lieu of the reference numbers of 100s in FIG. 1. A part having the similar configuration and the similar action to the member in the embodiment shown in FIG. 1 is not particularly described in this embodiment.

In this embodiment, the end on the upstream side 213 forming a boundary with a slope on the upstream side 211 of the flat top face 210 of plural record medium regulating members 204 is provided on the side of a paper feeding roller pair 201 outside a range of an ink nozzle array, that is, outside a range of nozzles Nos. 1 to N. Concretely, the end on the downstream side 223 of the flat top face 210 of a record medium regulating part 204 is provided on the upstream side from a range equivalent to approximately 30% on the downstream side in a range of the nozzle array 206 as shown in FIG. 11. That is, the whole top face 210 is provided near a point 225 nipped by the paper feeding roller pair 201 on the upstream side from the nozzle No. 1 at the front end.

In this embodiment, the side of the end in the sub scanning direction of the top face 210 of record medium regulating members 204*a* arranged in the vicinity of both ends in the main scanning direction out of plural record medium regulating members 204 is backed as shown in FIG. 11, compared with other members. This design complies with the size of printing paper most used for the printer and is adopted to relieve deformation at the corners at the rear end of the paper when the printing paper of the size comes off the paper feeding roller pair 201 and becomes free.

The paper feeding roller pair 201 is composed of a pair of a driving roller 214 and a driven roller 215 and is composed so that printing paper 202 is carried, nipping it by the pair of both rollers 214 and 215. The paper feeding roller pair 201 is composed so that a point 225 nipped by the paper feeding roller is located slightly upward from the top face 210 of the record medium regulating part 204 and pressure on the top face 210 is applied to the printing paper 202. The rotation of the driving roller 214 is controlled by a sub scanning drive unit 218 via a driving motor not shown and during printing, every time main scanning is finished, the sub scanning of the printing paper 202 is executed by fixed sub scanning distance. Also, a paper ejecting roller stack 205 is composed of a pair of a driving roller 216 to which power is transmitted from the driving motor of the paper feeding roller 201 via a gear train not shown and which is driven and two types of driven rollers 217*a* and 217*b* and ejects paper outside the body of the printer, nipping the printing paper 202.

Further, a driving controller 219 controls paper feeding so that the front end 220 of the printing paper 202 is ahead (on the downstream side) by the quantity of a margin at the upper end 222 based upon the position of a nozzle No. (T+1) located on the most downstream side in the sub scanning direction out of nozzles which can be driven when printing is started according to an interlace recording method as shown by an alternate long and short dash line in FIG. 11 after the front end 220 of the printing paper 202 reaches the end on the upstream side 213 of the top face 210 of the record medium regulating part 204 and is positioned. Printing according to a normal interlace recording method in which sub scanning by fixed distance and main scanning are alternately repeated in that state is started.

Next, referring to FIGS. 11 and 12, a process for printing paper by the ink-jet printer in the above embodiment will be described. The printing paper 202 is carried by the paper feeding roller pair 201 in a state in which the position of the front end 220 is grasped by the driving controller 219. A margin at the upper end 222 of 3 mm can be secured by feeding paper so that the front end 220 of the printing paper 202 is ahead (on the downstream side) by the quantity of a margin at the upper end 222, for example by 3 mm based upon the nozzle No. (T+1) which can be driven when printing is started according to the interlace recording method after the front end 220 reaches the end on the upstream side 213 of the top face 210, guided by the slope on the upstream side 211 of the record medium regulating part 204 and a paper gap is held fixed. Printing having a margin at the upper end of 3 mm and of high quality images can be realized with the simple structure of the controller by starting printing according to the interlace recording method in which sub scanning by fixed distance and main scanning are alternately repeated in that state.

Further, according to this embodiment, distance between the top face 210 of the record medium regulating part 204 and a point nipped by the paper feeding roller pair 201, which is arranged near a recording head 203 and upstream side of the recording head 203 is greatly shorter than that in a conventional prior art type. The shorter distance causes pressure to be generated and applied on the top face 210 to the printing paper 202, and the pressure effectively acts upon a printing area in a position opposite to the nozzle array 206, thereby, preventing the effect of wavy deformation due to cockling from reaching the printing area and the quality of a printed image can be maintained.

Figure 13:
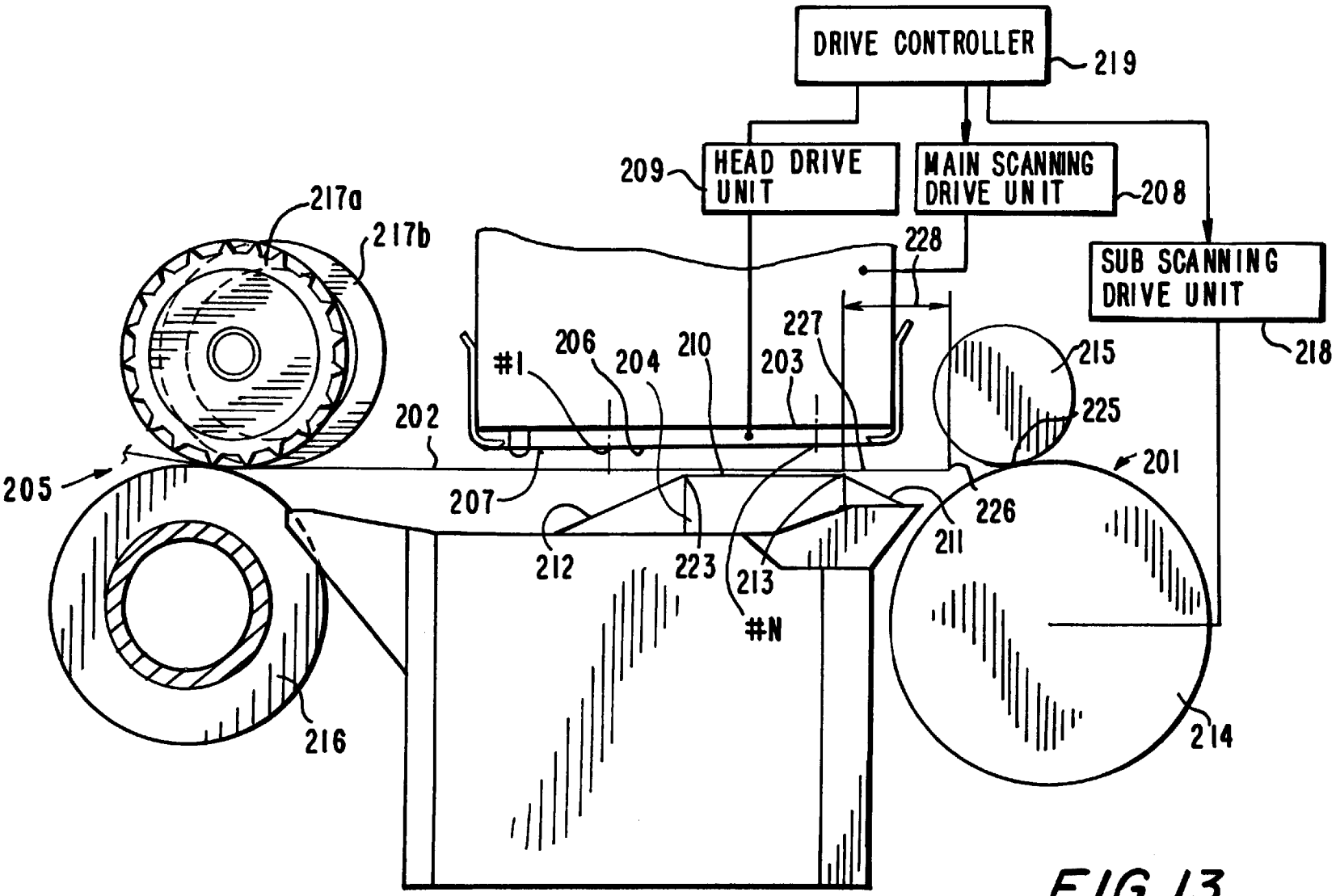
FIG. 13 is a side view showing the main part of the dot recording device in a state in which the rear end of printing paper comes off a nipped point on the paper feeding roller and becomes free.

Further, according to this embodiment, as shown in FIG. 13, distance between the top face 210 of the record medium regulating part 204 and the paper feeding roller pair 201 is greatly shorter than that in conventional prior art type designs. Even if printing is also executed after the rear end 226 of the printing paper 202 comes off the point 225 nipped by the paper feeding roller pair 201 and becomes free, the dimension 228 of an extension in a state in which a rear end part 227 including the rear end 226 of the paper is supported from the bottom by the top face 210 is reduced. Therefore, the downward inclination of the rear end 227 which is free of the paper can be reduced, a fixed paper gap can be securely maintained and printing of high quality images can be realized. If the end on the downstream side 223 of the flat top face 210 is provided on the upstream side from a range equivalent to approximately 30% on the downstream side in a range of the nozzle array 206 as in this embodiment, the following effect is acquired.

At first when printing is started, only a printed part is wetted by ink and the other part is dry. Therefore, only a printed part has a tendency to be slightly rolled up. However, if the end on the downstream side 223 of the flat top face 210 is located on the upstream side from a range equivalent to approximately 30% on the downstream side as described above, the front end of the paper promptly comes off the end on the downstream side 223 of the top face 210 and can be lowered even if a curl exists. Therefore, even if deformation due to a curl occurs on the paper 202, the effect can be relieved in a direction reverse to the surface 207 of the recording head and the deterioration of the quality of a printed image can be prevented.

As described above, according to this embodiment, printing in which a margin at the upper end 222 is sufficiently reduced can be realized with the simple structure of the controller, the wavy deformation of the printing paper 202 due to cockling can be effectively prevented from reaching a printing area opposite to the nozzle array 206, further, a paper gap can be also held fixed after the rear end part 227 of the printing paper 202 comes off the paper feeding roller and becomes free and printing of high quality images can be easily realized.

Figure 14:
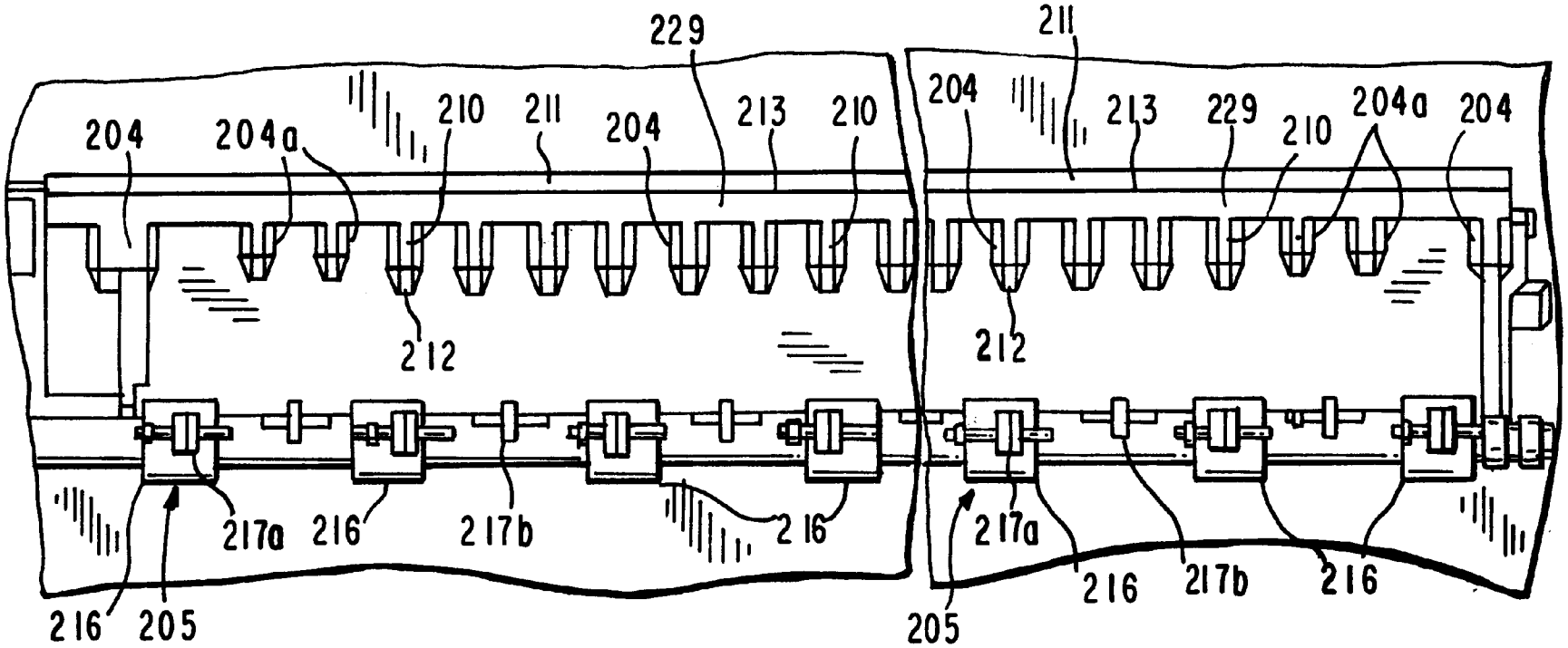
FIG. 14 is a plan view of the main part showing further another embodiment of the dot recording device according to the present invention.

FIG. 14 is a plan of the main part showing another embodiment of the ink-jet pr inter according to the present invention. In this embodiment, as the end on the upstream side 213 of the flat top face 210 of a record medium regulating part 204 is provided outside a range of a nozzle array 206 and on the side of a paper feeding roller pair 201, no ink adheres to a part outside a range of the nozzle array 206 of printing paper 202. As no cockling occurs in the part to ink does not adhere, the record medium regulating members 204 for supporting the printing paper 202 in this part from the bottom are not required to be separated from each other in the main scanning direction. Of the flat top face 210, only the upstream side in the sub scanning direction is not separated in the main scanning direction and a serial flat face 229 is formed for the top face. A paper gap before printing is started can be more securely fixed owing to the above serial flat structure. As the other configuration is similar to that in the embodiment shown in FIG. 11, the same reference numbers are allocated to the same parts and the descriptions thereof are omitted.

As an area in which a cockling phenomenon occurs on the downstream side in the sub scanning direction of the record medium regulating part 204 has structure that the record medium regulating members are separated from each other in the main scanning direction, the extension of the printing paper 202 due to cockling is relieved in this area and the printing paper 202 can be prevented from being lifted.

Figure 15:
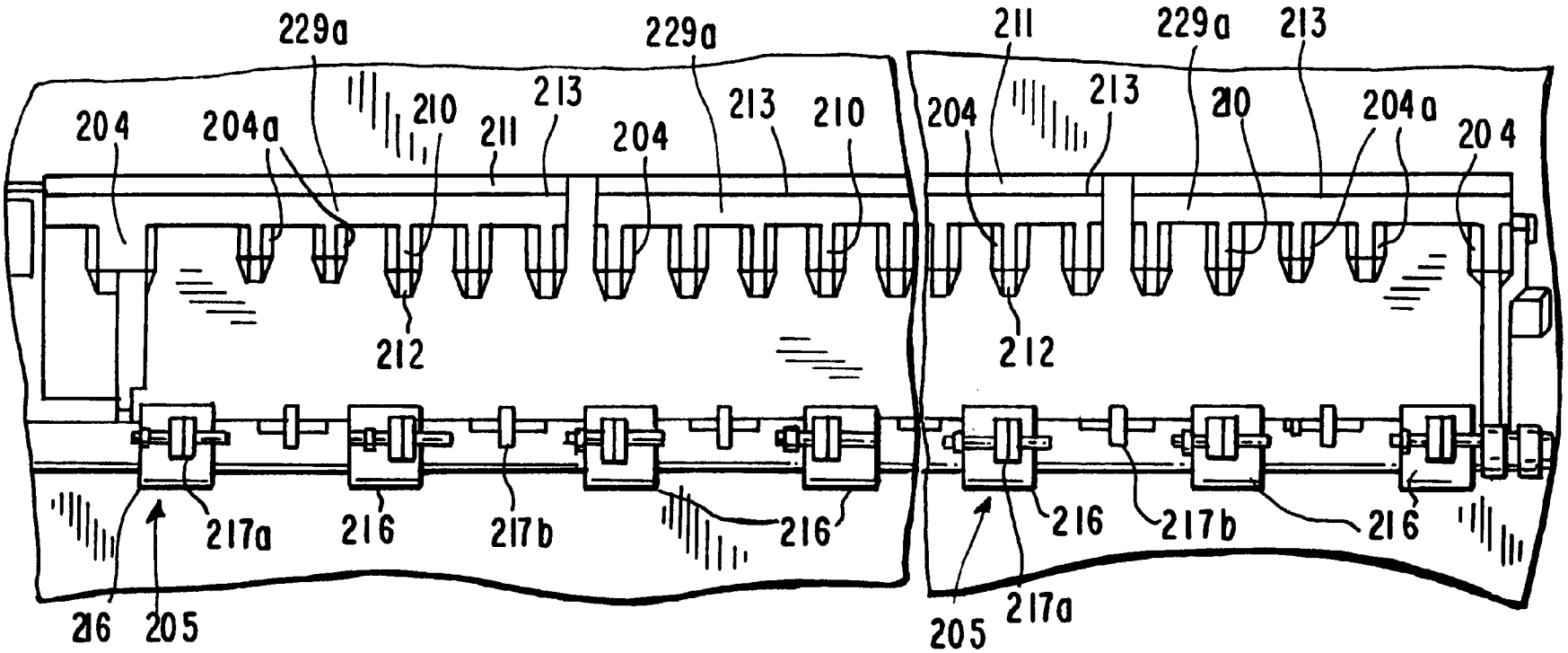
FIG. 15 is a side view of the main part showing further another embodiment of the dot recording device according to the present invention and is equivalent to a transformed example of the embodiment shown in FIG. 14.

FIG. 15 is a side view of the main part showing further another embodiment of the ink-jet printer according to the present invention. This embodiment is equivalent to a transformed example of the embodiment shown in FIG. 14. That is, the above serial structure (the serial flat face 229 shown in FIG. 14) of the top face 210 on the upstream side of a record medium regulating part 204 is formed as a divided flat face 229*a* divided into some pieces in the main scanning direction. Even if the top face is divided as described above, approximately the similar action and effect to the serial flat face shown in FIG. 14 are acquired.

Figure 16:
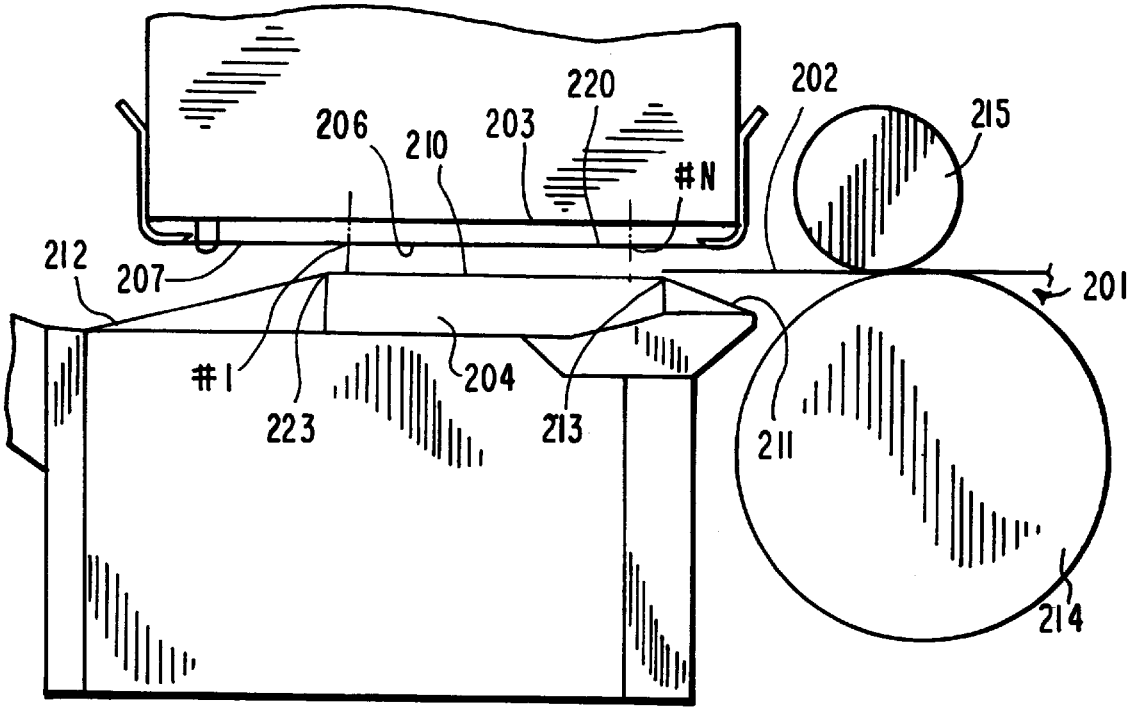
FIG. 16 is a side view of the main part showing the other embodiment of the dot recording device according to the present invention.

FIG. 16 is a side view of the main part showing further another embodiment of the ink-jet printer according to the present invention. In this embodiment, the end on the downstream side 223 of the flat top face 210 of a record medium regulating part 204 is located on the downstream side of a nozzle No. 1 at the front end in a nozzle array 206. However, the position of the end on the downstream side 223 may be also approximately equivalent to the position of the nozzle No. 1 at the front end. As the other configuration is similar to that shown in FIG. 11 the same reference number is allocated to the same part and the description is omitted.

According to this embodiment, as the top face 210 of the record medium regulating part 204 exists in a wider range than the whole length of the nozzle array 206 opposite to the nozzle array 206 as shown in FIG. 16, a paper gap can be held substantially fixed in a range exceeding the whole length of the nozzle array 206 and the certainty of realizing printing of high quality images is enhanced. This embodiment regards that a paper gap is held fixed across a range exceeding the whole length of the nozzle array 206 as more important than a countermeasure against a curl of the end of paper in the embodiment shown in FIG. 11.

According to the present invention, as the end on the upstream side of the flat top face of the record medium regulating part is provided on the side of the paper feeding roller from the position of elements at the rear end of the dot formation elements, a paper gap can be held fixed before the front end of the printing paper reaches a range of the nozzle array. Therefore, as described above, printing in which a margin at the upper end is sufficiently reduced can be realized with the simple structure of the controller, the wavy deformation of the printing paper due to cockling can be prevented from reaching a printing area opposite to the nozzle array, further, after the rear end of the printing paper comes off the paper feeding roller and becomes free, a paper gap can be also held fixed and printing of high quality images as in a photograph can be realized.

What is claimed is:

1. A dot recording device comprising:

a recording head on the surface of which a plurality of dot formation elements arranged at substantially fixed pitch in a sub scanning direction are provided to define an array;

a record medium regulating part arranged opposite to the surface of said recording head having a plurality of spaced-apart members aligned in a main scanning direction and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a sub scanning drive unit for executing the sub scanning of said record medium in a downstream sub scanning direction; and a driving for execution and controlling controller that executes an interlace recording method by controlling the driving of said main scanning drive unit, said head drive unit and said sub scanning drive unit, wherein the end on the upstream side of the flat top face of said record medium regulating part is provided within a range of the array of said dot formation elements; and said driving controller records a first line of a record object to be recorded using dot formation elements at the upstream end of the array after the front end of a record medium reaches the end on the upstream side of the top face of said record medium regulating part and is positioned, whereby sub scanning is repeated by a predetermined sub scanning distance and main scanning by the recording head to execute said interlace recording method.

2. A dot recording device according to claim 1, wherein the end on the upstream side of said flat top face is provided upstream from the center of the range of the array of said dot formation elements.

3. A dot recording device according to claim 2, wherein the end on the upstream side of said flat top face is provided in a position approximately equal to the position of the elements at the upstream end of the array of said dot formation elements.

4. A dot recording device according to claim 2, wherein the end on the downstream side of said flat top face is located upstream from the downstream end of the array at approximately 30% of the range of the array of said dot formation elements.

5. A dot recording device comprising:

a recording head on the surface of which a plurality of dot formation elements arranged at substantially fixed pitch in a sub scanning direction are provided to define an array;

a record medium regulating part arranged opposite to the surface of said recording head having a plurality of spaced-apart members aligned in a main scanning direction and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a sub scanning drive unit for executing the sub scanning of said record medium in a downstream sub scanning direction; and a driving controller for executing and controlling an interlace recording method by controlling the driving of said main scanning drive unit, said head drive unit and said sub scanning drive unit, wherein the flat top face of said record medium regulating part is provided in a position opposite to a range of the array of said dot formation elements; and the length of said top face in the downstream direction is formed to be approximately as long as the length of the array of said dot formation elements.

6. A dot recording device according to claim 5, wherein said driving controller records a first line of a record object to be recorded using the dot formation elements at the upstream end of the array after the front end of a record medium reaches the end on the upstream side of the top face of said record medium regulating part and is positioned, whereby sub scanning is repeated by a predetermined sub scanning distance and main scanning by the recording head to execute said interlace recording method.

7. A dot recording device comprising:

a recording head on the surface of which a plurality of dot formation elements arranged at substantially fixed pitch in a sub scanning direction are provided to define an array;

a record medium regulating part arranged opposite to the surface of said recording head having a plurality of spaced-apart members aligned in a main scanning direction and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a record medium feeding roller pair arranged near said recording head and upstream of said recording head such that a point nipped by said record medium feeding roller pair is located slightly upward from the top face of said record medium regulating part so that a record medium is pressed on said top face during feeding of the record medium;

an ejection roller arranged near said recording head and downstream of said recording head for ejecting a record medium downstream;

a sub scanning drive unit for executing the sub scanning of said record medium in a downstream sub scanning direction by controlling rotation of said record medium feeding roller and said ejection roller; and a driving controller for executing and controlling an interlace recording method by controlling the driving of said main scanning drive unit, said head drive unit and said sub scanning drive unit, wherein the end on the upstream side of the flat top face of said record medium regulating part is located between said record medium feeding roller pair and the upstream end of the array of said dot formation elements.

8. A dot recording device comprising:

a recording head on the surface of which a plurality of dot formation elements arranged at substantially fixed pitch in a sub scanning direction are provided to define an array;

a record medium regulating part arranged opposite to the surface of said recording head and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a record medium feeding roller pair arranged near said recording head and upstream side of said recording head such that a point nipped by said record medium feeding roller pair is located slightly upward from the top face of said record medium regulating part so that a record medium is pressed on said top face during feeding of the record medium;

an eject ion roller stack arranged near said recording head and downstream of said recording head for ejecting a record medium downstream;

a sub scanning drive unit for executing the sub scanning of said record medium in a downstream sub scanning direction by controlling rotation of said record medium feeding roller pair and said ejection roller stack; and a driving controller f or executing and controlling an interlace recording method by controlling the driving of said main scanning drive unit, said head drive unit and said sub scanning drive unit, wherein the end on the upstream side of the flat top face of said record medium regulating part is located between said record medium feeding roller pair and the upstream end of the array of said dot formation elements; and the downstream side of said record medium regulating part being composed of a plurality of spaced-apart members aligned in a main scanning direction, and the upstream side of said record medium regulating part extending in the main scanning direction between and joining at least two of said spaced-apart members with said top face extending continuously between said joined members to define a serial flat face.

9. A dot recording device according to claim 8, wherein said top face is divided into several portions in the main scanning direction.

10. A dot recording device according to claim 8, wherein the end on the downstream side of said flat top face is located upstream from the downstream end of the array at approximately 30% of the range of the array of said dot formation elements.

11. A dot recording device according to claim 8, wherein the end on the downstream side of the flat top face of said record medium regulating part is located in a position approximately equal to the position of elements at the downstream end of the array of said dot formation elements or downstream from the downstream end of the array of said dot formation elements.

12. A dot recording device comprising:

a recording head on the surface of which a plurality of dot formation elements arranged at substantially fixed pitch in a sub scanning direction are provided to define an array;

a record medium regulating part arranged opposite to the surface of said recording head having a plurality of spaced-apart members aligned in a main scanning direction and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a record medium feeding roller arranged near said recording head on the upstream side of said recording head for feeding a record medium on the side of said recording head;

an ejection roller stack arranged near said recording head and downstream of said recording head for ejecting a record medium downstream; and a sub scanning drive unit for executing the sub scanning of said record medium in a downstream sub scanning direction downstream by controlling each rotation of said record medium feeding roller pair and said ejection roller stack, wherein the position of a point nipped by said ejection roller stack is made higher than the position of the top face of said record medium regulating part as measured in a direction perpendicular to a route in which a record medium is carried so that the record medium is pressed downward, and wherein the flat top face of said record medium regulating part is located within a range of the array of said dot formation elements.

13. A dot recording device according to claim 12, wherein said dot recording device is provided with a driving controller for executing and controlling an interlace recording method for executing and controlling by controlling the driving of said main scanning drive unit, said head drive unit and said sub scanning drive unit.

14. A dot recording device according to claim 13, wherein the position of the top face of said record medium regulating part is backed up to the vicinity of approximately the center in a sub scanning direction of said recording head.

15. A dot recording device according to claim 13, wherein the position of the top face of a recording medium regulating member arranged at the end on both sides in a main scanning direction of said plural record medium regulating members is further backed, compared with the other record medium regulating members arranged in the center.

16. A dot recording device according to claim 15, wherein the position of the top face of both record medium regulating members located outside is the same as the position of the top face of said record medium regulating members in the center, and an interval between said record medium regulating members located outside and said record medium regulating members most backed is formed so that the interval is approximately twice as wide as an interval between the other record medium regulating members.

17. A dot recording device comprising:

a recording head on the surface of which a plurality of dot formation elements arranged at substantially fixed pitch in a sub scanning direction are provided to define an array;

a record medium regulating part arranged opposite to the surface of said recording head having a plurality of spaced-apart members aligned in a main scanning direction and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a sub scanning drive unit for executing the sub scanning of said record medium in a downstream sub scanning direction; and a driving for execution and controlling controller that executes an interlace recording method by controlling the driving of said main scanning drive unit, said head drive unit and said sub scanning drive unit, wherein at least a portion of the flat top face of said record medium regulating part is provided within a range of the array of said dot formation elements; and said driving controller records a first line of a record object to be recorded using dot formation elements at the upstream end of the array after the front end of a record medium reaches the end on the upstream side of the top face of said record medium regulating part and is positioned, whereby sub scanning is repeated by a predetermined sub scanning distance and main scanning by the recording head to execute said interlace recording method.

18. A dot recording device comprising:

a recording head on the surface of which a plurality of dot formation elements arranged at substantially fixed pitch in a sub scanning direction are provided to define an array;

a record medium regulating part arranged opposite to the surface of said recording head having a plurality of spaced-apart members aligned in a main scanning direction and provided with a flat top face for regulating an interval with said dot formation elements for a record medium being carried on the top face;

a main scanning drive unit for executing main scanning by said recording head in the main scanning direction;

a head drive unit for driving said dot formation elements during said main scanning and recording on a record medium;

a record medium feeding roller arranged near said recording head on the upstream side of said recording head for feeding a record medium on the side of said recording head;

an ejection roller stack arranged near said recording head and downstream of said recording head for ejecting a record medium downstream; and a sub scanning drive unit for executing the sub scanning of said record medium in a downstream sub scanning direction downstream by controlling each rotation of said record medium feeding roller pair and said ejection roller stack, wherein the position of a point nipped by said ejection roller stack is made higher than the position of the top face of said record medium regulating part as measured in a direction perpendicular to a route in which a record medium is carried so that the record medium is pressed downward, and wherein at least a portion of the flat top face of said record medium regulating part is located within a range of the array of said dot formation elements.

* * * * *

UNITED STATES PATENT AND TRADEMARK OFFICE

CERTIFICATE OF CORRECTION

PATENT NO. : 6,113,289 
DATED : September 5, 2000
INVENTOR(S) : Kazuo Saito, Eiji Kumai, Masatomo Kanamitsu and Tsuyoshi Tomii It is certified that error appears in the above-identified patent and that said Letters Patent is hereby corrected as shown below:

Item "[30], Foreign Application Priority Data", please insert the following text:
-- Jan. 5, 1998 [JP] Japan 10-12099
Sept. 4, 1998 [JP] Japan 10-250585 --

Signed and Sealed this

Sixth Day of November, 2001

*Attest:*

Nicholas P. Godici

NICHOLAS P. GODICI
*Acting Director of the United States Patent and Trademark Office*

*Attesting Officer*